US009664450B2

(12) United States Patent
Kinder et al.

(10) Patent No.: US 9,664,450 B2
(45) Date of Patent: May 30, 2017

(54) FIN SUPPORT STRUCTURES FOR CHARGE AIR COOLERS

(71) Applicant: Dana Canada Corporation, Oakville (CA)

(72) Inventors: Lee M. Kinder, Oakville (CA); David Lowe, Hannon (CA); Alan K. Wu, Kitchener (CA); Michael Bardeleben, Oakville (CA)

(73) Assignee: Dana Canada Corporation, Oakville, Ontario (CA)

( * ) Notice: Subject to any disclaimer, the term of this patent is extended or adjusted under 35 U.S.C. 154(b) by 488 days.

(21) Appl. No.: 14/250,779

(22) Filed: Apr. 11, 2014

(65) Prior Publication Data

US 2014/0318751 A1 Oct. 30, 2014

Related U.S. Application Data

(60) Provisional application No. 61/815,621, filed on Apr. 24, 2013.

(51) Int. Cl.
*F28D 1/053* (2006.01)
*F28F 1/12* (2006.01)
*F28D 7/16* (2006.01)

(52) U.S. Cl.
CPC ..... *F28D 1/05366* (2013.01); *F28D 7/1684* (2013.01); *F28F 1/128* (2013.01); *F28F 2240/00* (2013.01); *F28F 2275/143* (2013.01)

(58) Field of Classification Search
CPC .... F28D 1/05366; F28D 1/053; F28D 1/0341; F28D 7/1684; F28F 2280/00; F28F 9/02;
(Continued)

(56) References Cited

U.S. PATENT DOCUMENTS 3,021,804 A * 2/1962 Simpelaar ..... B21D 53/04 165/153
4,615,383 A * 10/1986 Hisao ..... F25B 39/02 165/150
(Continued)

FOREIGN PATENT DOCUMENTS

CN 2081963 U 7/1991
CN 1104762 A 7/1995
(Continued)

OTHER PUBLICATIONS

International Search Report with Written Opinion—PCT/CA2014/050370.

*Primary Examiner* — Tho V Duong
(74) *Attorney, Agent, or Firm* — Marshall & Melhorn, LLC

(57) ABSTRACT

A heat exchanger has a core comprising flat tubes with corrugated fins provided in spaces between tubes. An end mounting arrangement includes a mounting bracket for attachment to a housing. A fin support structure comprises a plurality of support walls and a plurality of axial walls, wherein each of the support walls is integrally joined to at least one of the axial walls, each of the support walls is in contact with the endmost corrugation of one of the fins, and each of the axial walls is in contact with one of the plate pairs. The fin support structure may have a corrugated structure, and is mounted at the end of the core at which the mounting bracket is provided, so as to support and minimize damage to the corrugated fins caused by bypass air flowing between the mounting bracket and the core.

20 Claims, 15 Drawing Sheets

(58) Field of Classification Search
CPC .. F28F 9/005; F28F 9/007; F28F 9/002; F28F 9/001; F28F 1/105; F28F 1/128; F28F 3/12; F28F 3/10; F28F 3/083; F28F 3/027
See application file for complete search history.

(56) References Cited

U.S. PATENT DOCUMENTS

| | | | | |
|---|---|---|---|---|
| 4,945,981 | A | 8/1990 | Joshi | |
| 5,086,832 | A * | 2/1992 | Kadle | F28D 1/0341 165/76 |
| 5,111,877 | A * | 5/1992 | Buchanan | F28D 1/0341 165/152 |
| 5,318,114 | A * | 6/1994 | Sasaki | F28D 1/035 165/109.1 |
| 5,390,519 | A * | 2/1995 | Kuroda | B21D 35/00 29/890.052 |
| 5,457,885 | A | 10/1995 | Ohashi et al. | |
| 5,479,985 | A | 1/1996 | Yamamoto et al. | |
| RE35,890 | E | 9/1998 | So | |
| 6,006,430 | A * | 12/1999 | Fukuoka | B23K 1/0012 165/149 |
| 6,019,169 | A | 2/2000 | Ruppel et al. | |
| 6,179,049 | B1 | 1/2001 | Higgins | |
| 6,241,011 | B1 * | 6/2001 | Nakamura | F25B 39/024 165/153 |
| 6,273,183 | B1 | 8/2001 | So et al. | |
| 6,932,152 | B2 | 8/2005 | Iwasaki et al. | |
| 7,500,515 | B2 | 3/2009 | Tsuji et al. | |
| 7,775,067 | B2 | 8/2010 | Ichiyanagi | |
| 8,656,988 | B1 * | 2/2014 | Paul | F28D 1/05366 165/151 |
| 2004/0226693 | A1 | 11/2004 | Iwasaki et al. | |
| 2005/0061494 | A1 | 3/2005 | Tsuji et al. | |
| 2007/0012430 | A1 | 1/2007 | Duke et al. | |
| 2007/0017661 | A1 | 1/2007 | Geskes et al. | |
| 2009/0266104 | A1 | 10/2009 | Ichiyanagi | |
| 2010/0319894 | A1 | 12/2010 | Biver et al. | |
| 2011/0036546 | A1 | 2/2011 | Kohl et al. | |
| 2012/0024509 | A1 | 2/2012 | Ueno | |
| 2012/0061366 | A1 | 3/2012 | Kohl et al. | |
| 2012/0222848 | A1 | 9/2012 | Sicks et al. | |
| 2012/0255709 | A1 * | 10/2012 | Kinder | F28F 9/002 165/67 |
| 2012/0272677 | A1 * | 11/2012 | Furumaki | F28D 1/05383 62/290 |
| 2012/0301771 | A1 | 11/2012 | Moser et al. | |
| 2013/0068438 | A1 | 3/2013 | Matsumoto et al. | |
| 2013/0086938 | A1 | 4/2013 | Higashiyama et al. | |

FOREIGN PATENT DOCUMENTS

| | | | | |
|---|---|---|---|---|
| GB | 1486805 | A * | 9/1977 | F28F 9/001 |
| WO | 2005040708 | A1 | 5/2005 | |

* cited by examiner

FIN SUPPORT STRUCTURES FOR CHARGE AIR COOLERS

CROSS-REFERENCE TO RELATED APPLICATION

This application claims priority to and the benefit of U.S. Provisional Patent Application No. 61/815,621 filed Apr. 24, 2013, the contents of which are incorporated herein by reference.

FIELD OF THE INVENTION

The invention generally relates to plate and fin type heat exchangers such as charge air coolers, and particularly to support structures for preventing damage to the edges of cooling fins caused by air flowing about the exposed edges of the fins.

BACKGROUND OF THE INVENTION

Plate and fin type heat exchangers typically have a core comprising a plurality of flat tubes for carrying a liquid coolant. The tubes are arranged in a stack, with spaces being provided between the tubes for circulation of air. Corrugated cooling fins may be provided between adjacent plate pairs to enhance heat transfer from the coolant to the air. The cooling fins are made from very thin metal sheet material or foil, and are susceptible to damage. Also, in many cases the side walls of the cooling fins are provided with perforations or louvers to enhance their performance, however, the presence of these perforations can make the cooling fin more delicate and increase its susceptibility to damage.

In one particular application, the inventors have found that the presence of an air flow stream, such as a bypass flow, about the ends of a heat exchanger core, in contact with the sides of the fins, can result in cracking or partial destruction and loss of portions of the fins. While it may be desirable to eliminate bypass flow or other air flow about the ends of the heat exchanger core, it is not always feasible to do so. Therefore, there is a need for means to prevent damage to cooling fins which do not rely solely on the elimination of bypass air flow.

SUMMARY OF THE INVENTION

In one aspect, there is provided a heat exchanger having a core comprising: (a) a plurality of flat tubes arranged in parallel relation to one another in a stack, wherein spaces are defined between adjacent pairs of said tubes, wherein the tubes have a length which is defined in a direction parallel to a longitudinal axis and a width transverse to the longitudinal axis, wherein the core has a first end and a second end spaced apart along the longitudinal axis, and wherein each of the tubes has a hollow interior defining a first fluid flow passage; (b) a plurality of corrugated cooling fins, wherein each of the fins is provided in a space between an adjacent pair of said tubes, wherein each of the spaces defines a second fluid flow passage, wherein each of the fins comprises a metal sheet in which a plurality of parallel bends define a series of corrugations, the corrugations comprising a plurality of side walls, top walls and bottom walls, wherein the side walls are arranged in spaced, side-by-side relation to one another, with adjacent side walls being joined together by one of said top walls or one of said bottom walls; wherein the top walls and bottom walls are each in contact with one tube of the adjacent pair of tubes, and wherein the side walls extend transversely along the width of the tubes; wherein an edge of the fin extends along the first end of the core, and is spaced inwardly from the first end, the edge of the fin being defined by an endmost one of said corrugations; (c) a fin support structure comprising a plurality of support walls and a plurality of axial walls, wherein each of the support walls is integrally joined to at least one of the axial walls, wherein each of the support walls is in contact with the endmost corrugation of one of the fins, and wherein each of the axial walls is in contact with one of the plate pairs.

In another aspect, each of the support walls is brazed to the endmost corrugation of one of the fins, and wherein each of the axial walls is brazed to one of the tubes.

In yet another aspect, each of the support walls of the fin support structure is integrally joined at its top edge to a first one of said axial walls, and is integrally joined at its bottom edge to a second one of said axial walls, such that each of the support walls and the axial walls to which it is joined form a U-shaped channel; and wherein the fin support structure comprises a plurality of said U-shaped channels. For example, each of said U-shaped channels may be individually formed.

In yet another aspect, the fin support structure has a corrugated structure wherein each of the support walls of the fin support structure is integrally joined at its top edge to a first one of said axial walls, and is integrally joined at its bottom edge to a second one of said axial walls; and wherein the fin support structure further comprises a plurality of connecting walls, each of which is integrally joined at its top edge to a first one of said axial walls, and is integrally joined at its bottom edge to a second one of said axial walls, wherein the connecting walls are located beyond the first end of the core and are spaced longitudinally from the support walls.

In yet another aspect, the heat exchanger further comprises a bracket mounting pin extending from the first end of the core, and wherein the fin support structure has a cutout in one of its connecting walls to receive the bracket mounting pin.

In yet another aspect, the heat exchanger further comprises a mounting bracket mounted on said mounting pin, the mounting bracket having a vertical plate portion in close proximity to the fin support structure, wherein a plurality of the connecting walls of the fin support structure have cutouts which together correspond to the shape and size of the vertical plate portion.

In yet another aspect, the fin support structure comprises a plate having a plurality of apertures spaced apart along its height, each of the apertures being sized and shaped to closely receive a closed end of one of the tubes; wherein the support walls of the fin support structure comprise portions of said plate extending between adjacent pairs of said apertures; wherein the axial walls of the fin support structure comprise axial flanges extending from edges of the apertures. The apertures may be formed by cutting widthwise slits in the plate and wherein the axial flanges are formed by outwardly bending portions of the plate adjacent to the slits. The axial flanges may be provided along top and bottom edges of each of the apertures, or they may be formed along either a top edge or a bottom edge of one of said apertures. At least some of said apertures may each be provided with a first one of said axial flanges along its top edge and a second one of said axial flanges along its bottom edge, and/or wherein at least some of said apertures are each provided with a single one of said axial flanges, which is provided along its top or bottom edge.

In yet another aspect, the apertures have edges which are spaced from edges of the plate, such that continuous edge pieces extend along substantially the entire height of the fin support structure; and wherein the continuous edge pieces are bent along their length to form axial stiffening flanges.

In yet another aspect, each of the flat tubes comprises a pair of core plates, each of which has a planar peripheral flange surrounding a raised central portion, and wherein the core plates of each said pair are arranged in face-to-face relation with one another, with the peripheral flanges of the plates joined together and with the raised central portions spaced apart to define said hollow interior of the flat tube.

In yet another aspect, the heat exchanger further comprises a top plate and a bottom plate, wherein a space is defined between the top plate and an adjacent plate pair, and a space is defined between the bottom plate and an adjacent plate pair, and wherein the core comprises two additional corrugated cooling fins, one of which is provided in the space between the top plate and said adjacent plate pair, and the other of which is provided in the space between the bottom plate and said adjacent plate pair.

In yet another aspect, the flat tubes are closed at the first end of the core.

In yet another aspect, a width of each said corrugated cooling fin is less than the width of each said flat tube with which it is in contact, and wherein the width of each said corrugated cooling fin is less than a width of the fin support structure. The fin support structure may have a pair of edges separated by the width of the fin support structure, wherein at least one edge of the edges of the fin support structure extends beyond an edge of the corrugated cooling fin.

In yet another aspect, a width of each said corrugated cooling fin is less than the width of each said flat tube with which it is in contact, and wherein the width of each said corrugated cooling fin is less than a width of the fin support structure; wherein the fin support structure has a pair of edges separated by the width of the fin support structure, and one of said edges is in close proximity to said mounting bracket; wherein said one edge of the fin support structure extends beyond an edge of the corrugated cooling fin; and wherein said one edge of the fin support structure is separated from the mounting bracket by a gap.

In yet another aspect, the heat exchanger further comprises a bracket mounting pin extending from the first end of the core, and a mounting bracket mounted on said mounting pin, the mounting bracket comprising: a first wall portion in close proximity to the fin support structure and extending widthwise along the first end of the core, and through which the bracket is mounted on said mounting pin; a second wall portion projecting from the first wall portion at an angle of about 90 degrees and extending over a portion of the heat exchanger core; wherein the second wall portion covers a portion of each of the spaces between adjacent pairs of said flat tubes, and longitudinally overlaps the edge of each said corrugated cooling fin which extends along the first end of the core. The second wall may comprise a comb arrangement having a plurality of spaced-apart teeth, wherein each of the teeth extends into one of said spaces between an adjacent pair of said flat tubes. The bracket mounting pin may be mounted on an end of a first one of said flat tubes, wherein the first fluid flow passage of said first flat tube is spaced from the first end of the core by a distance which is greater than a distance between the first fluid flow passage and the first end of the core in the other flat tubes, wherein the corrugated cooling fins in the spaces adjacent to said first flat tube are spaced away from the first end of the core by a distance which is at least as great as the distance between the first fluid flow passage of the first flat tube and the first end of the core; and wherein the teeth of the comb arrangement extending into the spaces between the first flat tube and adjacent tubes of the core are elongated along the longitudinal axis, relative to the other teeth, so as to overlap the edges of the corrugated cooling fins in said spaces.

BRIEF DESCRIPTION OF THE DRAWINGS

The invention will now be described, by way of example only, with reference to the accompanying drawings in which.

DETAILED DESCRIPTION

The heat exchangers described herein are gas-liquid heat exchangers for cooling compressed charge air in a supercharged or turbocharged internal combustion engine, or in a fuel cell engine.

Figure 1:
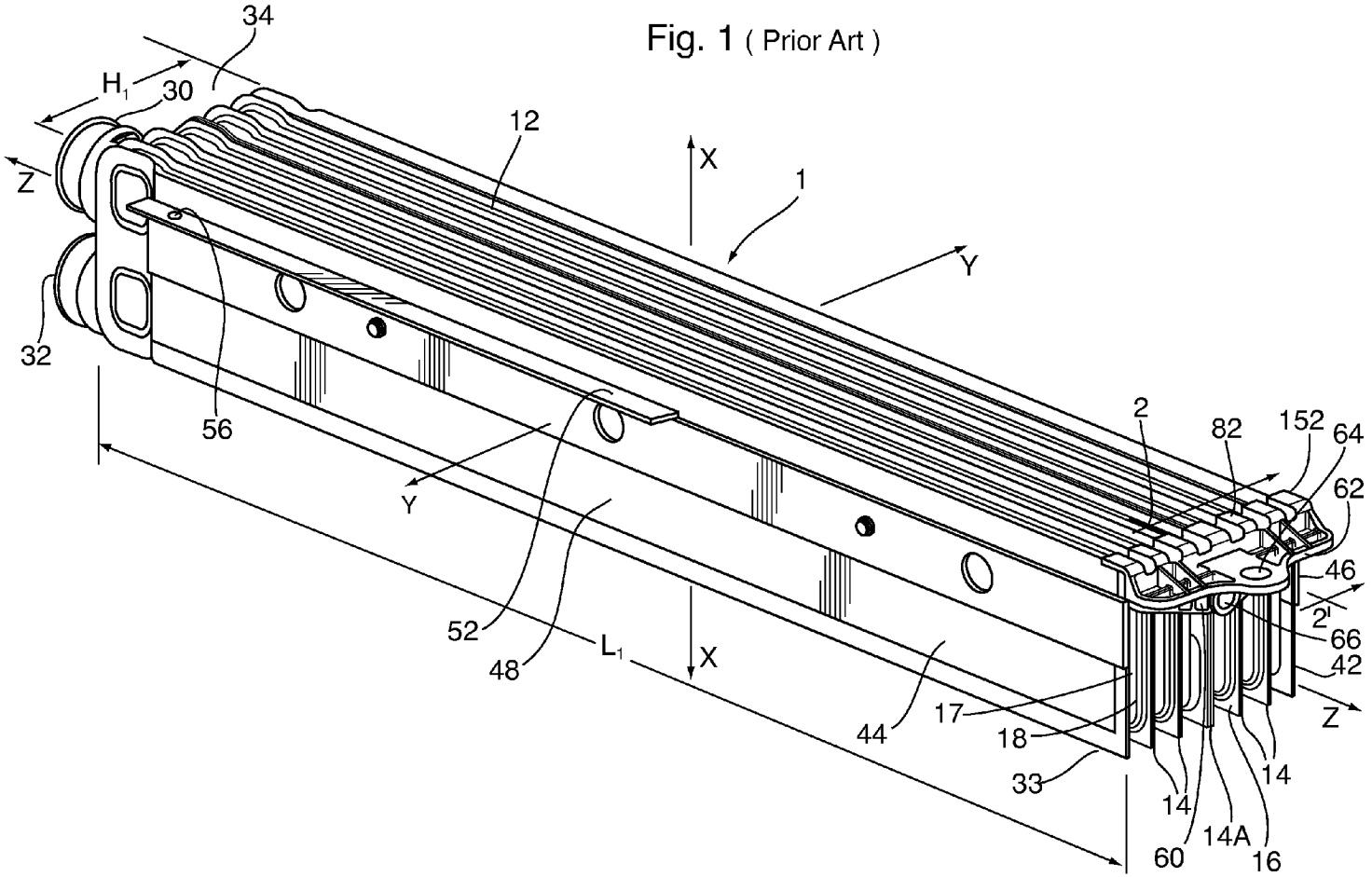
Fig. 1 ( Prior Art )
FIG. 1 is a perspective view of a heat exchanger according to the prior art.
Figure 2:
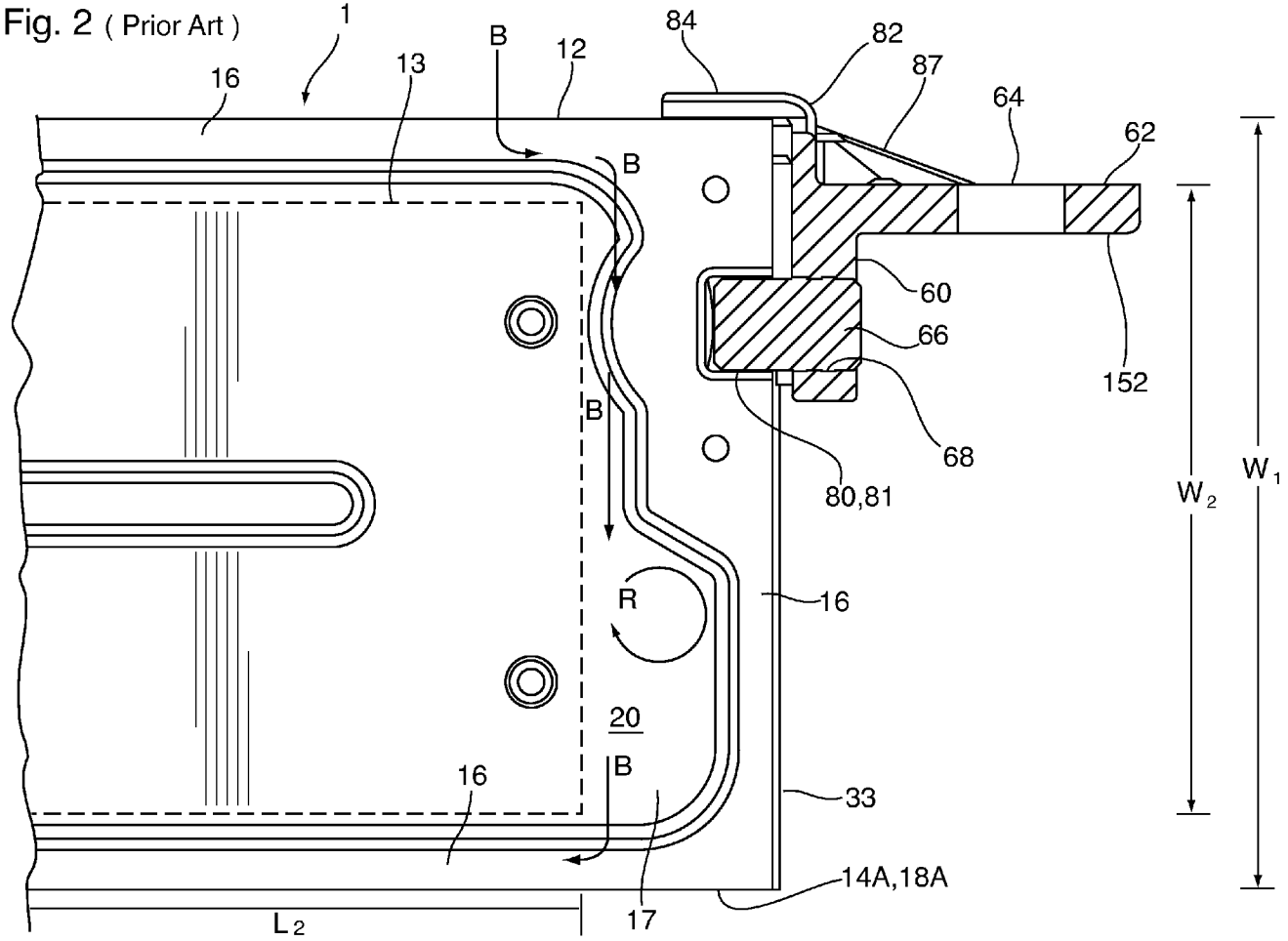
Fig. 2 ( Prior Art )
FIG. 2 is across-section along line 2-2' of FIG. 1.
Figure 3:
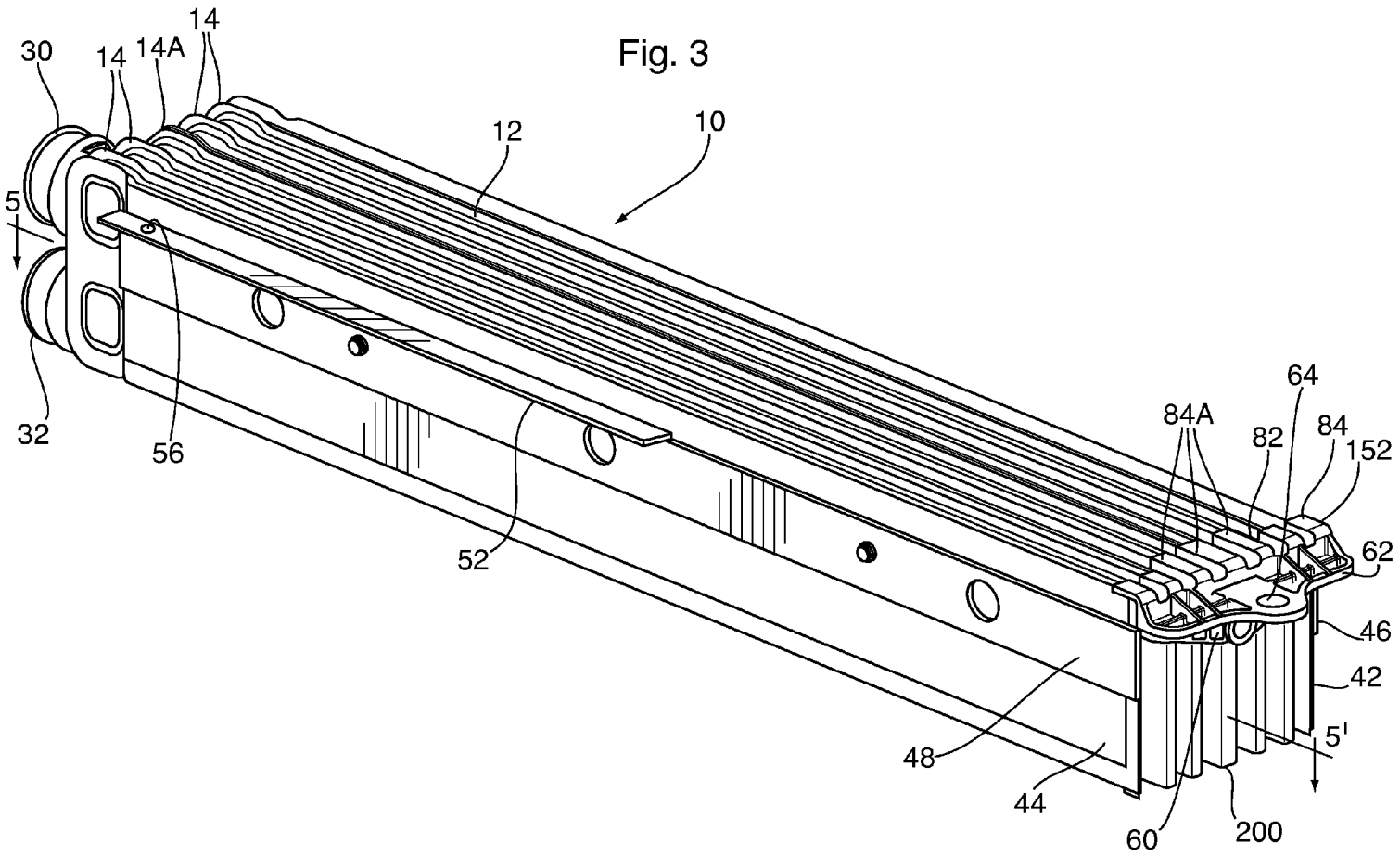
FIG. 3 is a perspective view of a heat exchanger having a fin support structure according to a first embodiment the invention.
Figure 4:
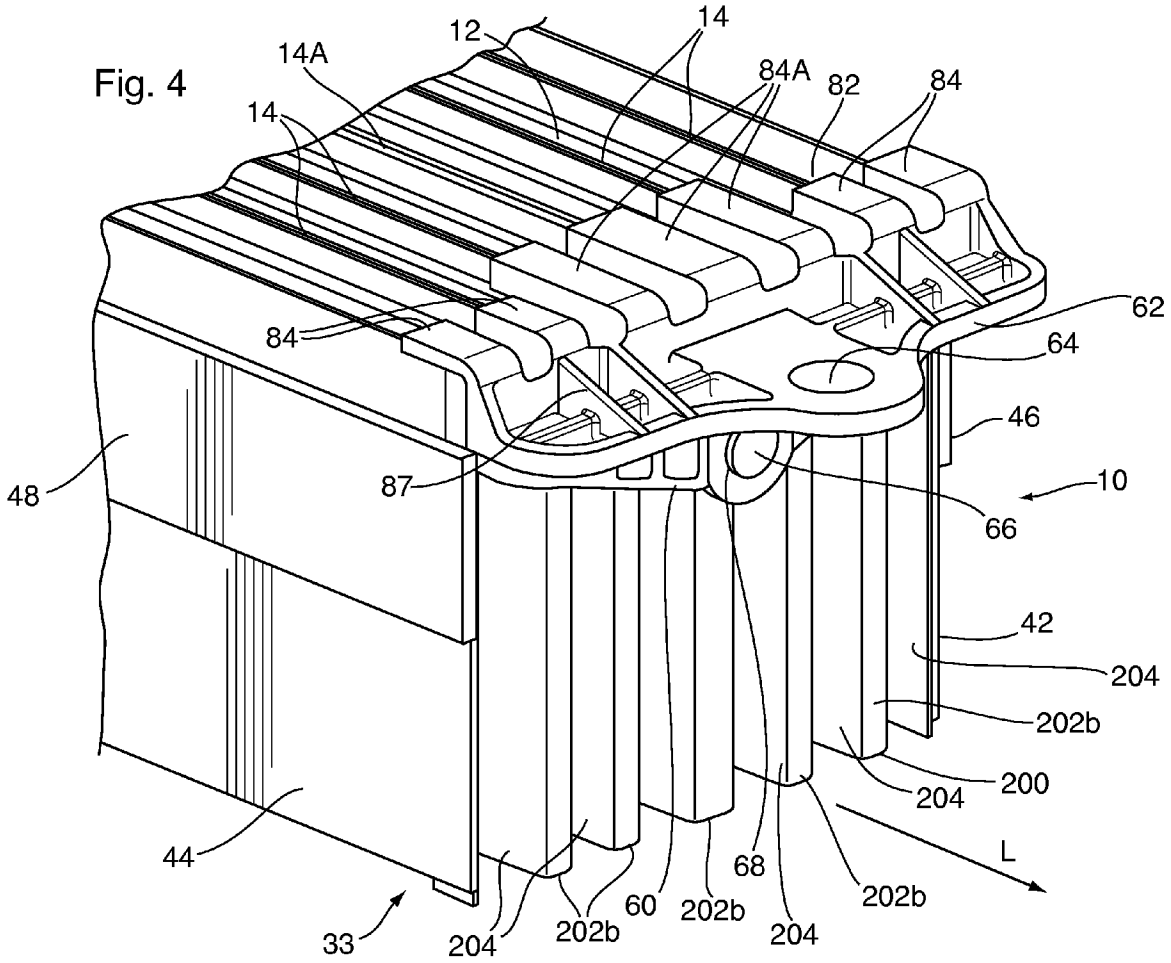
FIG. 4 is a close-up of a portion of the heat exchanger of FIG. 3.
Figure 5:
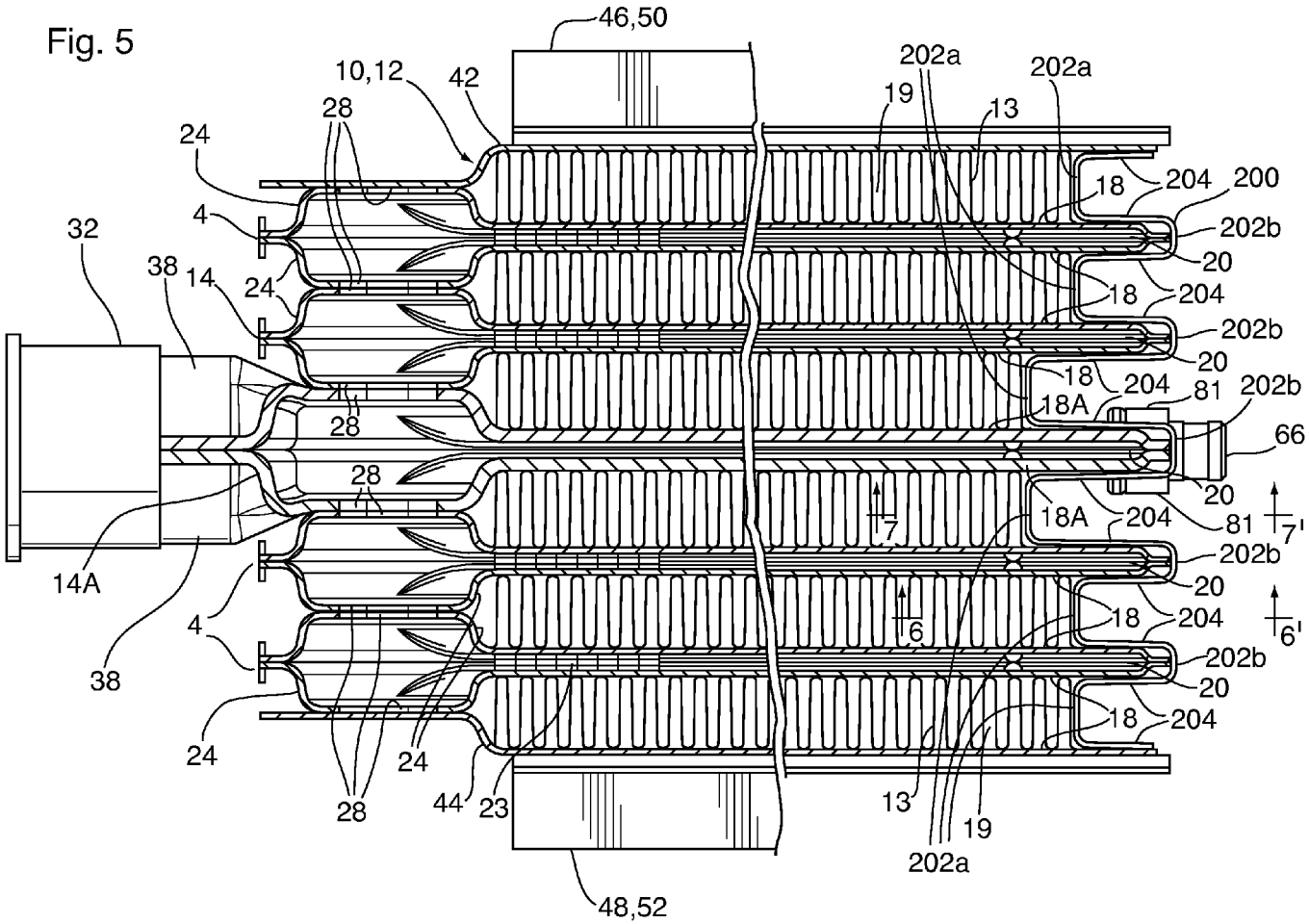
FIG. 5 is a longitudinal cross-section along line 5-5' of FIG. 3.

FIGS. 1 and 2 illustrate a heat exchanger 1 according to the prior art, as described in commonly assigned U.S. patent application Ser. No. 13/440,064, published on Oct. 11, 2012 as US 2012/0255709 A1, which is incorporated herein by reference in its entirety.

Prior art heat exchanger 1 is particularly configured for use in a supercharged internal combustion engine and has a relatively elongate, rectangular shape to supply intake air to a row of cylinders in the engine. This heat exchanger 1 is intended to be enclosed within a housing (not shown) and is located in an air flow path between an air compressor (not shown) and the intake manifold of the engine (not shown).

The prior art heat exchanger 1 is of the plate and fin type, and has a core 12 comprising a plurality of flat tubes 14 arranged in parallel relation to one another in a stack. In the embodiment shown in the drawings, the flat tubes 14 are each formed from a pair of core plates 18, and therefore the flat tubes 14 are sometimes referred to herein as plate pairs 14. The plate pairs 14 and the core plates 18 each have a length $L_1$ (FIG. 1) which is defined in a direction parallel to a longitudinal axis Z. The width $W_1$ (FIG. 2) of each plate pair 14 and of the core 12 is defined along axis X and the height $H_1$ (FIG. 1) of the core 12 is defined along axis Y, wherein axes X and Y are both transverse (perpendicular) to axis Z. The core 12 has a first end 33 and a second end 34 which are spaced apart along axis Z.

The core 12 further comprises a plurality of cooling fins 13. For convenience, the cooling fins 13 are not shown in FIG. 1, but the outline of a cooling fin 13 is shown in dotted lines in FIG. 2. Cooling fins 13 are also illustrated in drawings showing embodiments of the invention, including FIGS. 5, 8, 9, 12 and 13. Each of the cooling fins 13 is provided in a space between an adjacent pair of plate pairs 14, wherein each of the spaces defines an air flow passage 19, and it will be appreciated that cooling fins 13 may be provided throughout the length (along axis Z) of every air flow passage 19 in core 12.

The core plates 18 making up each plate pair 14 are joined together in face-to-face relation at their peripheral edges, for example by brazing. The central portions 17 of the plates 18 are raised relative to the peripheral edges, such that each plate pair 14 has a hollow interior defining an internal coolant flow passage 20 through which a liquid coolant flows between an inlet opening and an outlet opening. The coolant flow passages 20 may be provided with turbulence-enhancing inserts (not shown). The peripheral edges of the plates 18, surrounding raised central portions 17, are in the form of planar flanges 16, and the plates 18 are joined together along these flanges 16. Some of these details are also shown in drawings showing embodiments of the invention, such as FIG. 9.

In this particular plate configuration, the coolant flow passage 20 is U-shaped and each plate 18 has a pair of raised, apertured bosses 22, 24 adjacent to one another at the one end of the plate pair 14, proximate to the second end 34 of core 12. When the plate pairs 14 are assembled and are stacked to form the core 12, the raised bosses 22, 24 of adjacent plate pairs 14 are joined together, for example by brazing, so as to provide inlet and outlet manifolds which permit distribution of the coolant throughout the height of the heat exchanger core 12. Thus, the apertures in the raised bosses of the plates are referred to herein as the inlet manifold openings and outlet manifold openings, respectively. In this configuration, it can be seen that the ends of the plate pairs 14 proximate to the first end 33 of core 12 are completely sealed along the peripheral flanges 16 of the plates 18. Again, some of these details are also shown in drawings showing embodiments of the invention, such as FIG. 5.

It will be appreciated that other plate configurations are possible, for example the inlet and outlet manifold openings and associated bosses 22, 24 may be located at opposite ends of the plate pairs 14, with the coolant flow passage 20 comprising a single channel extending along the length of the plate pair 14.

The heat exchanger core 12 is also provided with inlet and outlet fittings 30, 32 which communicate with the respective inlet and outlet manifolds. The fittings 30, 32 extend out from the second end 34 of the core 12, and the second end 34 is sometimes referred to herein as the "fitting end" 34. There are numerous ways to attach fittings 30, 32 to the second end 34 of the core 12 of plate and fin heat exchanger 1. As more fully described in above-mentioned U.S. patent application Ser. No. 13/440,064, the fittings 30, 32 may both be attached to the edge of one of the plate pairs 14A which is located approximately in the middle of the core 12. This is accomplished by providing each plate 18A in this plate pair 14A with a pair of semi-circular bulges at its edge. Each bulge forms one-half of a coolant inlet or outlet opening. These bulges are in flow communication with the respective raised bosses 22, 24 in which the respective manifold openings are provided, thereby providing flow communication between the inlet and outlet fittings 30, 32 and the respective manifolds. Although the fittings 30, 32 in the prior art heat exchanger 1 extend from the second end 34 of the core 12, it will be appreciated that the fittings may instead be provided at the sides of the core 12. Also, although both fittings 30, 32 extend from the edge of a single plate pair 14A, it is possible to provide the inlet and outlet openings and the fittings 30, 32 in different plate pairs 14.

The ends of the heat exchanger core 12 are provided with top and bottom plates 42, 44 which close the manifold openings of the two endmost plate pairs 14, and which provide surfaces to which mounting brackets may be secured. In the illustrated embodiment, each plate 42, 44 is provided with a respective top or bottom mounting bracket 46, 48. Each mounting bracket 46, 48 includes a vertical plate portion which is secured to the side plate, for example by brazing, and an outwardly extending flange 50, 52 (only flange 52 is visible in FIG. 1) for mounting the heat exchanger 1 within the housing (not shown). Each of the flanges 50, 52 is provided with an aperture 54, 56 (only aperture 56 is visible in FIG. 1) through which the heat exchanger 1 is rigidly secured to the housing, for example by bolts (not shown). The apertures 54, 56 in the top and bottom brackets 46, 48 are both located adjacent the fitting end 34 of the heat exchanger 1, and serve to rigidly mount the fitting end 34 of the heat exchanger 1 within the housing.

The first end 33 of the prior art heat exchanger 1, opposite to the fitting end 34, is provided with an end mounting bracket 152 for mounting the heat exchanger 1 within the housing. The end mounting bracket 152 includes a first wall portion extending widthwise (parallel to axis X) along the first end 33 of core 12. In the present embodiment the first wall portion comprises a vertical plate portion 60 which is mounted to the first end 33 of the heat exchanger core 12. At the upper edge of the plate portion 60 is a flange 62 extending outwardly away from the first end 33 of core 12 and having an aperture 64 through which the end mounting bracket 152 is rigidly secured to the housing by a fastener such as a bolt (not shown).

The upper edge of the end mounting bracket 152 is molded to extend backwards from flange 62, providing a second wall portion, which in the present embodiment comprises providing a comb arrangement 82 to minimize bypass air flow. As shown in the drawings, the first wall portion projects inwardly from the first wall portion (vertical plate portion 60) at an angle of about 90°, extending over a portion of core 12. This comb arrangement 82 includes a plurality of spaced-apart teeth 84, which are joined together and extend into the spaces between the edges of two adjacent plate pairs 14. The bracket 152 also has a plurality of ribs 87 to enhance rigidity.

The end bracket mounting arrangement includes a bracket mounting pin 66 which is rigidly secured to the heat exchanger core 12 and extends into an aperture 68 provided in the first wall portion (plate portion 60) of the end mounting bracket 152, such that the bracket 152 is mounted on pin 66. It will be appreciated that the end mounting bracket 152 may be modified to have more than one aperture 68 in cases where more than one pin 66 is mounted to the heat exchanger core 12. The end mounting bracket 152 is typically made from a rigid, heat-resistant plastic. Due to the inherent resilience of the plastic material comprising bracket 152, there is no need to provide a resilient grommet in the aperture 68 for vibration reduction.

The edge of plate pair 14A, located at the first end 33 of core 12, is provided with a pin aperture 80 which is sized to closely receive the pin 66. The aperture 80 is formed by a clamshell arrangement whereby each plate 18A of the plate pair 14A has a semi-circular bulge 81 at its edge to form one-half of pin aperture 80. The pin aperture 80 may be located in a plate pair 14A which is centrally located in the core 12, and which is the same plate pair 14A in which the coolant inlet and outlet openings are provided, and to which fittings 30, 32 are attached. This arrangement may provide cost benefits in that it minimizes the number of special plate pairs 14 which are required in the core 12. Also, the plate pair 14A may optionally be thicker than the other plate pairs 14, and this additional thickness may provide better support for pin 66. As an alternative to the pin mounting arrangement of FIG. 2, it will be appreciated that the pin 66 may be mounted to the end of plate pair 14A using any of the arrangements disclosed in U.S. patent application Ser. No. 13/440,064.

The heat exchanger housing has at least one inlet opening for relatively hot air, and at least one outlet opening for cooled air, with the inlet and outlet openings being arranged such that the air flows through the air flow passages 19 as it passes from the inlet to the outlet. With the heat exchanger 1 in the orientation shown in FIG. 1, the air flows through air flow passages 19 throughout the width W1 of heat exchanger core 12, parallel to axis X.

Cooling fins 13 are provided between adjacent plate pairs 14. Also, a space exists between the topmost plate pair 14 in the core 12 and the top plate 42, and a space exists between the bottommost plate pair 14 in the core 12 and the bottom plate 44. These spaces also form air flow passages 19 and are provided with cooling fins 13. The structure and orientation of the cooling fins 13 is now described below, partly with reference to FIG. 9, which illustrates an embodiment of the invention.

Heat from the coolant is transferred through the walls of core plates 18 to the cooling fins 13, and is then transferred to the air flowing through passages 19. Each cooling fin 13 comprises a thin metal sheet or foil in which parallel bends define a series of corrugations of generally rectangular, triangular or rounded form, arranged in the form of a strip or bank of corrugations. The corrugations comprise a series of side walls 94 arranged in spaced, side-by-side relation to one another, with adjacent side walls 94 being joined together by a top wall 96 or bottom wall 98. As used herein, the singular term "fin" refers to all the corrugations in a single air flow passage 19 rather than to the individual corrugations, regardless of whether the corrugations in the air flow passage 19 are made up of one or more strips or banks of corrugations. The plural term "fins" as used herein refers to the strips or banks or corrugations in two or more of the air flow passages 19.

Openings 100 are defined between adjacent side walls 94 of each fin 13 to permit air flow through the fin 13. The fins 13 are oriented with their side walls 94, top walls 96 and bottom walls 98 extending along the width $W_1$ of the core 12, parallel to the direction of air flow (i.e. parallel to axis X), and with the openings 100 facing the direction of air flow along axis X.

In order to provide efficient conduction of heat from the core plates 18 to the fins 13, the top and bottom walls 96, 98 are in intimate contact with the core plates 18, top plate 42 and bottom plate 44, and may be brazed thereto. The side walls 94 of fins 13 may be perforated, crimped or interrupted in order to increase turbulence of the air flowing through air flow passages 19. For example, the side walls of fins 13 may be provided with louvers as described in commonly assigned U.S. patent application Ser. No. 11/183,687, published on Jan. 18, 2007 as US 2007/0012430 A1, or in U.S. Pat. No. 4,945,981 (Joshi). Alternatively, the fins 13 may comprise turbulizers, or offset or lanced strip fins, such as those described in U.S. Pat. No. Re. 35,890 (So) and U.S. Pat. No. 6,273,183 (So et al.), which are incorporated herein by reference in their entireties.

The cooling fins 13 cover only the areas of the plate pairs 14 in which the coolant flow passages 20 are provided, and do not extend to the edges of the plate pairs 14 at which the peripheral flanges 16 of plates 18 are joined together, and at which the plate portion 60 of bracket 152 is located. Thus, the cooling fins 13 have substantially the same or slightly smaller dimensions than the raised central portions 17 of the core plates 18. In this regard, the cooling fins have a length $L_2$ (partly shown in FIG. 2), measured along axis Z, which is slightly less than the length $L_1$ of the core 12, and a width $W_2$ (FIG. 2), measured along axis X, which is slightly less than the width $W_1$ of the core 12. The difference between $W_1$ and $W_2$ is about twice the width of the peripheral flange 16. Also, in most of the plate pairs 14, the difference between $L_1$ and $L_2$ will correspond to about twice the width of the peripheral flange 16. However, in the central plate pair 14A, the coolant flow passage 20 (formed by raised portions 17 of plates 18A, and also referred to herein as the first fluid flow passage) is spaced farther back from the edge of plate pair 14A due to the presence of pin 66. Therefore, the edge of fin 13 will similarly be located farther back from the edge of plate pair 14A so that it will be bonded to the raised portion 17 of plate 18A along its entire width, as shown in FIG. 2. As a result, the difference between $L_1$ and $L_2$ in the central plate pair 14A is greater than twice the width of the peripheral flange 16 in the illustrated embodiment.

In addition, the cooling fins 13 have a height $H_2$ (FIG. 9), measured along axis Y, which is equal to the distance between the raised central portions 17 of plates 18 in adjacent plate pairs 14, such that the top and bottom walls 96, 98 of the cooling fin 13 are in contact with the adjacent raised central portions 17.

Despite the presence of the comb arrangement 82 of end mounting bracket 152, hot air can flow between the bracket 152 and the heat exchanger core 12 of prior art heat exchanger 1, for example as illustrated by arrows B in FIG. 2, bypassing the cooling fins 13 at the first end 33 of the heat exchanger core 12, in the area where the peripheral edges of plates 18 are joined together and extend out toward the end mounting bracket 152. As illustrated by arrows B, a portion of the hot air impinging on the fronts of the air flow passages 19 (along axis X), near the rear edge of the comb arrangement 82, will tend to turn sideways and flow along the top edge of the cooling fins 13, parallel to axis Z. The hot bypass air flowing over the surfaces of the cooling fins 13 moves at high velocity and can have a damaging effect on the fins 13, leading to cracking or partial destruction and loss of portions of the fins 13. The opposite ends of the fins 13, at the bottom of heat exchanger 1, may be similarly damaged by the flow of hot bypass air. Although not wishing to be bound by theory, the inventors believe that fin damage may be at least partially caused by swirling air flow in a plenum located between the heat exchanger 1 and the cylinders to which the charge air is fed, for example as indicated by arrow R in FIG. 2.

It is possible to reduce bypass flow between the heat exchanger core 12 and the end mounting bracket 152 by providing a resilient sealing material between the comb arrangement 82 of bracket 152 and the heat exchanger core 12. The resilient sealing material can be in the form of a resilient gasket or other sealing material. However, the inventors have found that the presence of a resilient seal is not sufficient to eliminate fin damage, particularly at the bottom of the heat exchanger 1.

Rather than seeking to eliminate bypass flow, the present invention provides structures to support the fins 13 at the end of heat exchanger core 12 proximate to end mounting bracket 152. A first embodiment of a heat exchanger 10 including a fin support structure 200 is now described with reference to FIGS. 3 to 11. The heat exchanger 10 described below is identical to heat exchanger 1 described above, except that it includes fin support structure 200 and the comb structure 82 of mounting bracket 152 is enhanced so as to minimize bypass flow. Therefore, like elements of heat exchangers 1 and 10 are identified by like reference characters, and the above description of like elements of heat exchanger 1 applies equally to the description of the elements of heat exchanger 10, and will not be repeated.

The comb structure 82 of mounting bracket 152 in heat exchanger 10 is similar to that of prior art heat exchanger 1, comprising a plurality of teeth 84 extending back from the vertical plate portion 60 of bracket 152 by a sufficient distance to overlap the leading edges of the coolant flow passages 20 and the leading edges of the cooling fins 13, thereby helping to minimize the space between the comb structure 82 and the cooling fins 13 through which bypass air can flow. As mentioned above, in the air flow passages 19 adjacent to the central plate pair 14A, the leading edges of the cooling fins 13 are located farther back from the leading edge of plate pair 14A, than in the other air flow passages 19. This difference can be seen, for example, in FIG. 5. In order to provide overlap between the comb structure 82 and the cooling fins 13 in the air flow passages 19 adjacent to central plate pair 14A, the central region of comb structure 82 includes elongated teeth 84A which extend farther back from vertical plate portion 60 (i.e. elongated along axis Z), so as to overlap with the leading edges of the cooling fins 13 adjacent to the central plate pair 14.

The fin support structure 200 has a height $H_3$ (see FIGS. 9 and 10) which is substantially the same as the height $H_1$ of the heat exchanger core 12, which is defined as the distance between the top and bottom plates 42, 44. The fin support structure 200 also has a width $W_3$ (FIG. 10) which is substantially the same or slightly less than the width $W_1$ of the core 12, and greater than the width $W_2$ of the fins 13. Therefore, the fin support structure 200 provides support along substantially the entire width $W_2$ of each fin 13 and extends beyond the edges of each fin 13.

The fin support structure 200 is a unitary structure having an appearance similar to a corrugated fin, comprising a sheet of metal in which parallel bends define a series of corrugations of generally rectangular form, although it will be appreciated that the bends are not necessarily angular. The metal sheet from which the fin support structure 200 is formed may be of a thicker gauge than the metal comprising fins 13. The fin support structure 200 includes transversely extending wall portions 202 connected together by axially extending wall portions 204, also referred to herein as axial walls 204. The transversely extending wall portions 202 are substantially transverse to longitudinal axis Z, while the axially extending wall portions 204 are substantially parallel to axis Z.

Figure 9:
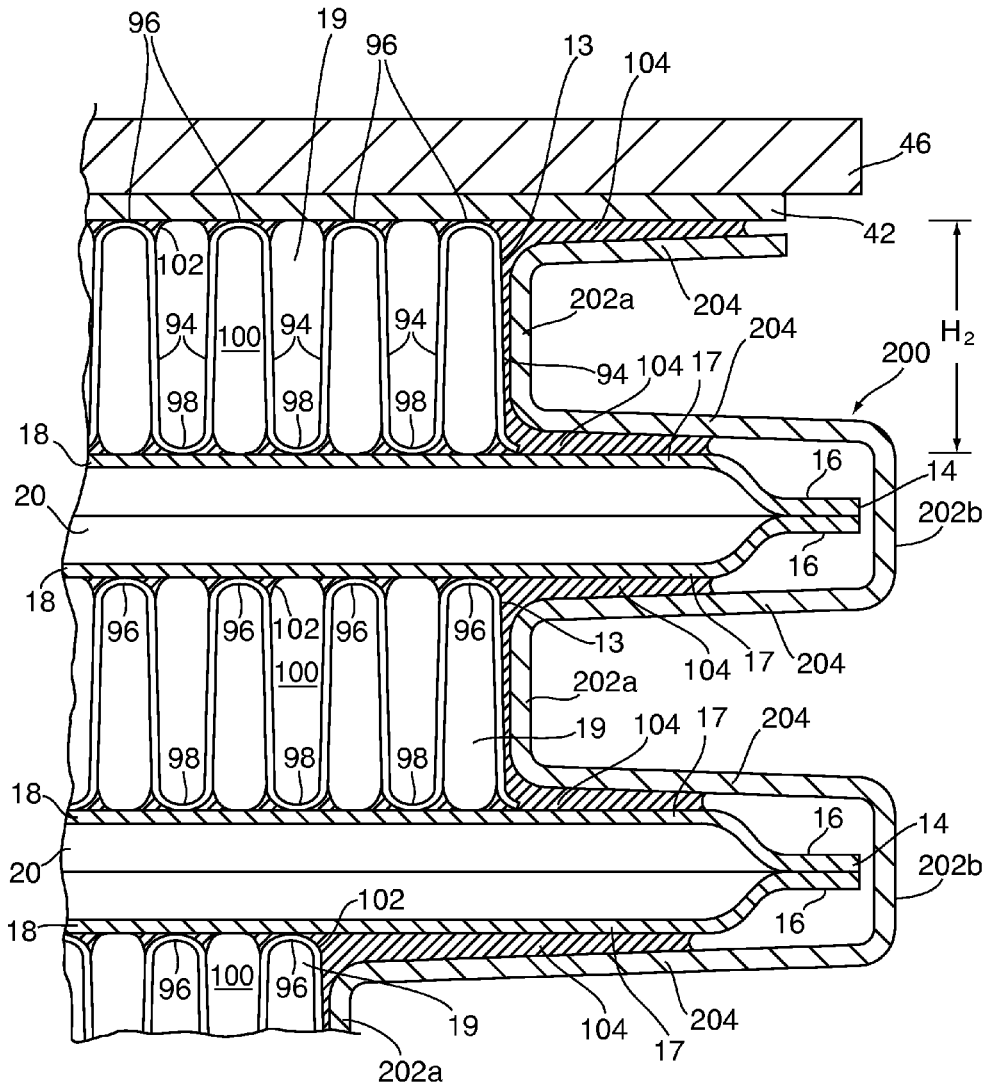
FIG. 9 is a partial, enlarged side elevation view of the first end of the core of the heat exchanger of FIG. 3.

A first plurality of the transversely extending wall portions 202 are located inwardly of the ends of plate pairs 14, and are sometimes referred to herein as support walls 202*a*. Each of the support walls 202*a* extends between two adjacent plate pairs 14, or between a plate pair 14 and the top or bottom plate 42, 44, and is in contact with the endmost corrugation of one of the fins 13, and may be on contact with a side wall 94 of the endmost corrugation. As can be seen from FIG. 9, the axially extending wall portions 204 of support structure 200 extend inwardly of the edge of core 12 by an amount which is greater than the width of peripheral flange 16, and overlap with the edges of the raised central portions 17 of the plates 18. Therefore, the support walls 202*a* extend between the raised central portions 17 of plates 18 in adjacent plate pairs 14, and have a height which is slightly less than the height $H_2$ of the fins 13. Support may be enhanced by brazing together the endmost corrugations of fins 13 and the support walls 202*a* which are in contact with one another, and FIG. 9 shows a braze fillet 104 joining an endmost sidewall 94 of each fin 13 to one of the support walls 202*a*.

A second plurality of the transversely extending wall portions 202 are located at the ends of the plate pairs 14, more precisely between the ends of plate pairs 14 and the vertical plate portion 60 of the mounting bracket 152. These wall portions are sometimes referred to herein as connecting walls 202*b*, and these walls 202*b* have a height which is slightly greater than the thickness of a plate pair 14 (measured along axis Y).

The support walls 202*a* and the connecting walls 202*b* are joined together by the axial walls 204. Each of the axial walls 204 is in contact with a core plate 18 of a plate pair 14 or with the top plate 42 or bottom plate 44. Braze joints may also be provided between each axially extending wall portion 204 and the raised portion 17 of core plate 18, top plate 42 or bottom plate 44 which it is in contact with, and FIG. 9 shows braze fillets 104 joining each of the axial walls 204 to either the raised portion 17 of a core plate 18 or to top plate 42. Although FIG. 9 shows the axial walls 204 spaced apart from the core plates 18 and top plate 42, it will be appreciated that the spaces may be smaller than those shown, or the axial walls 204 may be in contact with the core plates 18 and/or the top plate. It will also be appreciated that the spacing may vary pre- and post-braze, or due to variances in the heights of fins 13.

Figure 6:
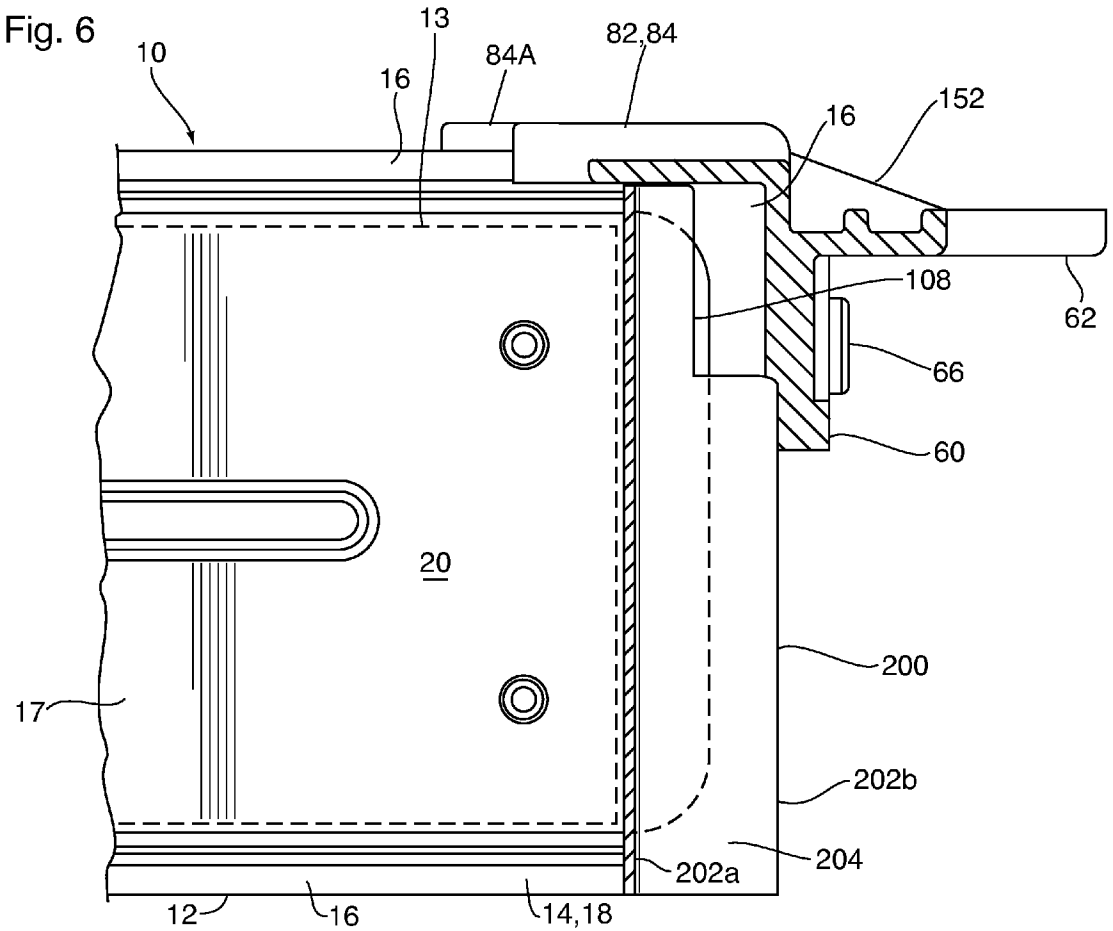
FIG. 6 is a partial longitudinal cross-section along line 6-6' of FIG. 5.
Figure 7:
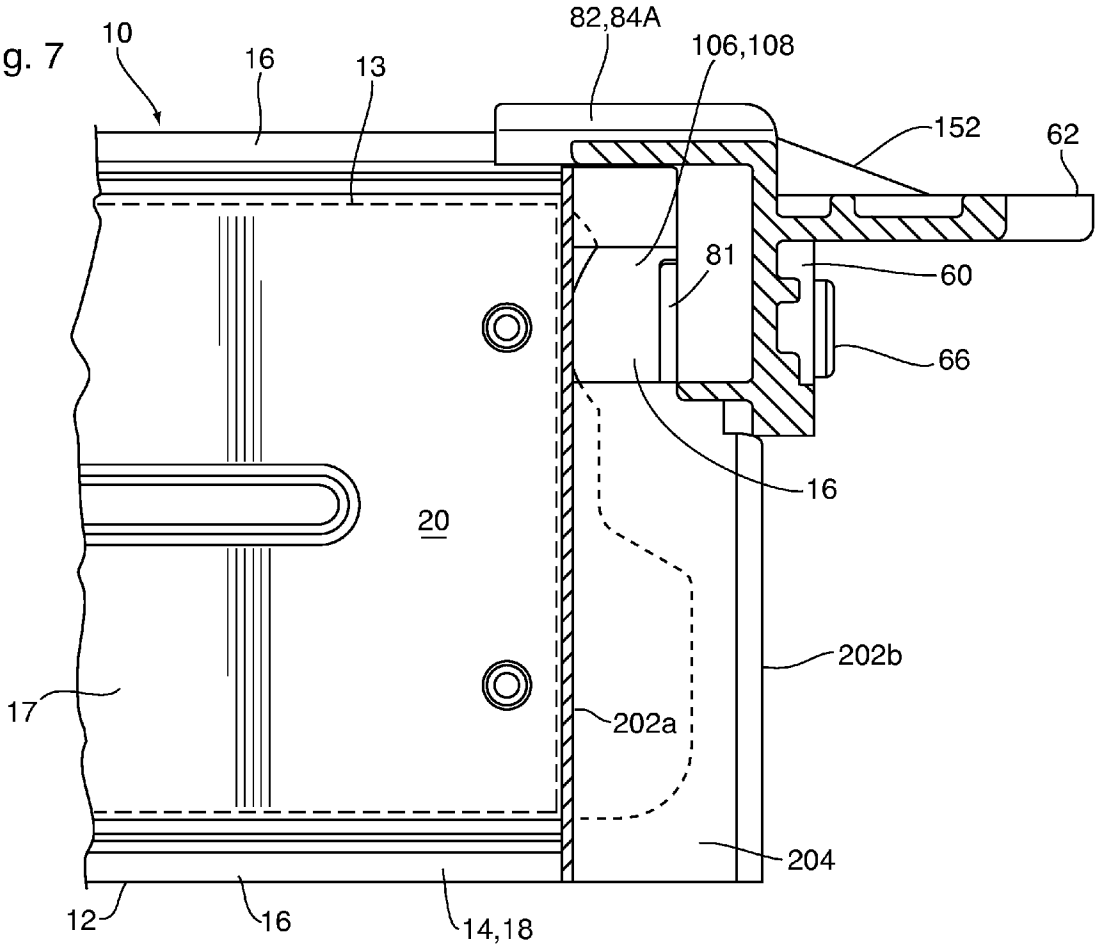
FIG. 7 is a partial longitudinal cross-section along line 7-7' of FIG. 5.

As mentioned above, the axial walls 204 of support structure 200 extend inwardly of the edge of core 12 and overlap the raised portions 17 of plates 18. This can also be seen in FIGS. 6 and 7. FIG. 6 shows the side of one of the plate pairs 14 which does not carry pin 66, and shows the extent to which the axial wall 204 of support structure 200 overlaps the raised portion 17 of plate 18. The location of support wall 202*a* in FIG. 6 defines the edge of the fin 13, the approximate dimensions of which are defined by a dotted line. FIG. 7 shows the side of the central plate pair 14A which carries the pin 66. Because pin 66 extends into the plate pair, the coolant flow passage 20 is spaced farther back from the edge of plate pair 14A in the vicinity of pin 66. Therefore, the edge of fin 13 will be located farther back from the edge of plate pair 14 so that it will be bonded to the raised portion 17 of plate 18A along its entire width. As a result, the axial wall 204 overlaps the raised portion 17 of plate 18A by a greater amount than in FIG. 6, and has a length (along axis Z) which is greater than the lengths of the axial walls 204 in other portions of support structure 202. This difference in length can also be seen in FIGS. 9 and 10.

Figure 10:
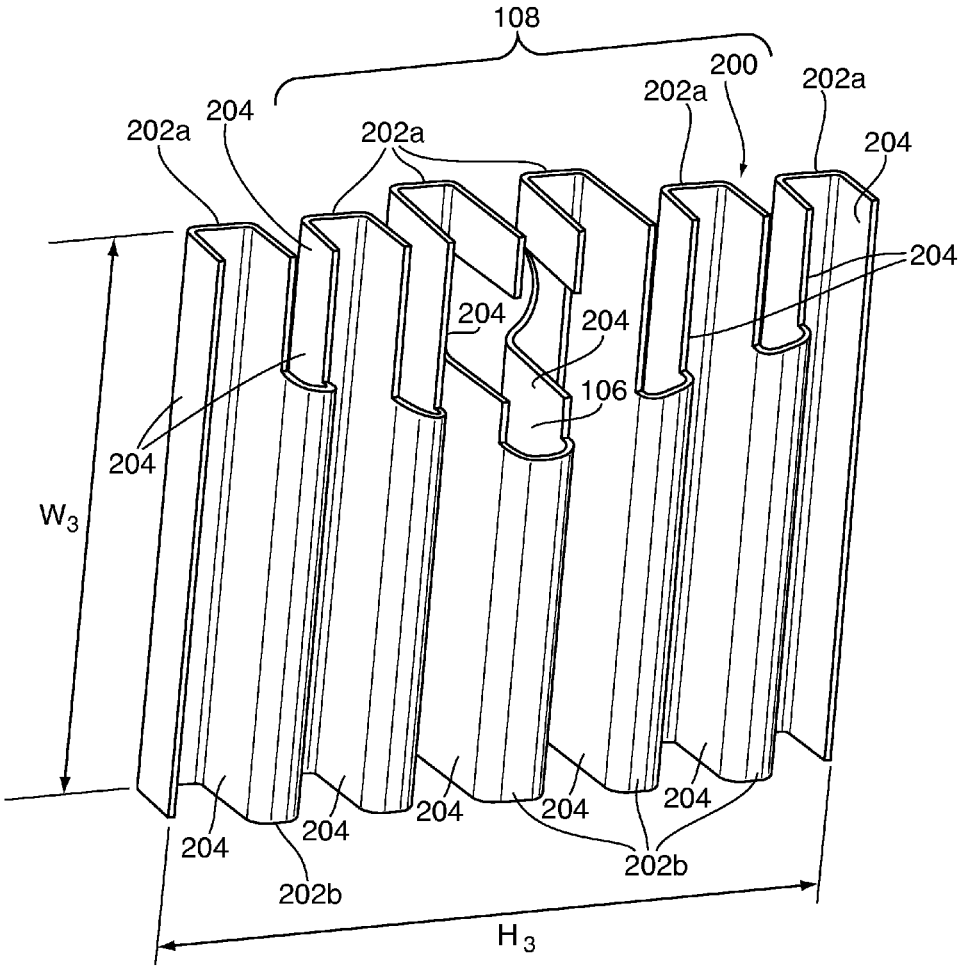
FIG. 10 is an isolated view of a first variant of the fin support structure in the heat exchanger of FIG. 3.

The fin support structure 200 has a central cutout 106 through which the mounting pin 66 protrudes. As shown in FIG. 10, the support structure 200 also includes a larger cutout 108 which follows the contours of the vertical plate portion 60 of the mounting bracket 152. The cutout 108 allows a closer fit between the mounting bracket 152 and the first end 33 of the core 12, while maintaining the support walls 202*a* along the entire width of the fin support structure 200.

Figure 11:
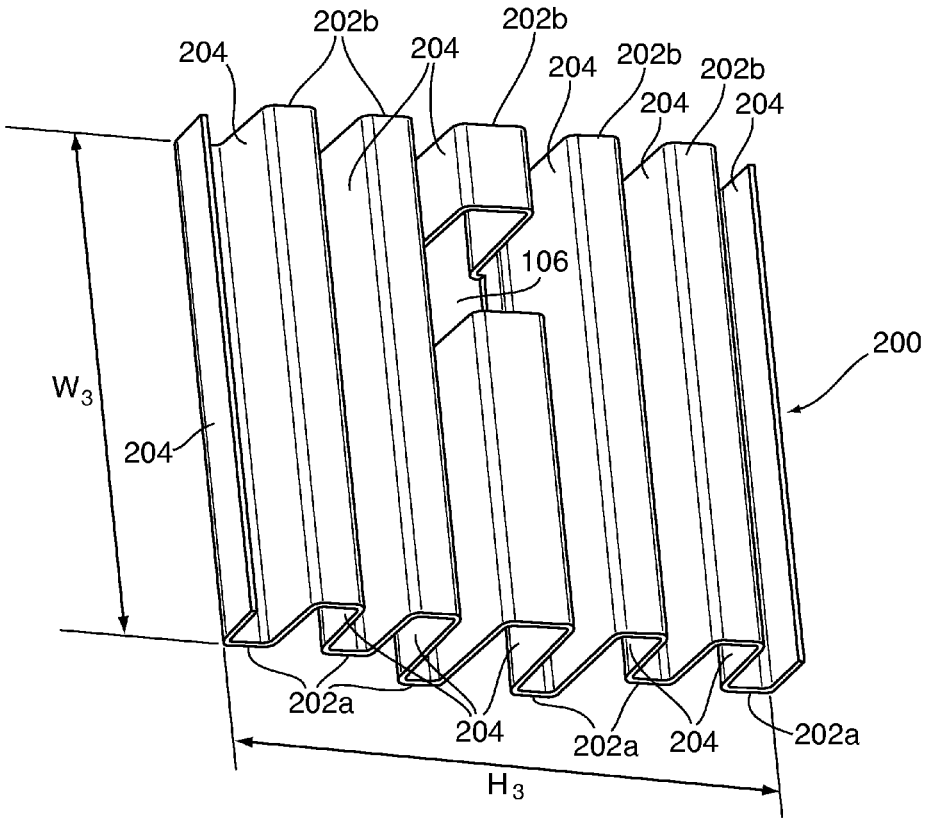
FIG. 11 is an isolated view of a second variant of the fin support structure in the heat exchanger of FIG. 3.

FIG. 11 shows a modified version of fin support structure 200 in which the larger cutout 108 is eliminated, and in which the only cutout is the central cutout 106.

It can be seen that the fin support structure 200 provides added support along the edges of the fins 13 and, particularly where the support walls 202*a* and the axial walls 204 are brazed to the surfaces of the fins 13, core plates 18, top plate 42 and/or bottom plate 44 which they are in contact with. While the presence of fin support structure 200 does not eliminate bypass flow around the edges of the fins 13, it can be seen that the fin support structure 200 prevents the bypass air from flowing over the edges of the fins 13, thereby reducing the damaging effects of the bypass air flow. Since the fin support structure 200 extends throughout the entire width of the core 12, it protects the fins 13 along their entire width $W_3$, thereby providing protection against damage caused by bypass flow and by swirling air flow in the plenum between the heat exchanger 10 and the cylinders to which the charge air is fed. In addition, the brazing of axial walls 204 to both the top and bottom plates 42, 44 of the heat exchanger provides additional support for the ends of the top and bottom plates 42, 44 in areas where they are unsupported by the fins 13.

Figure 8:
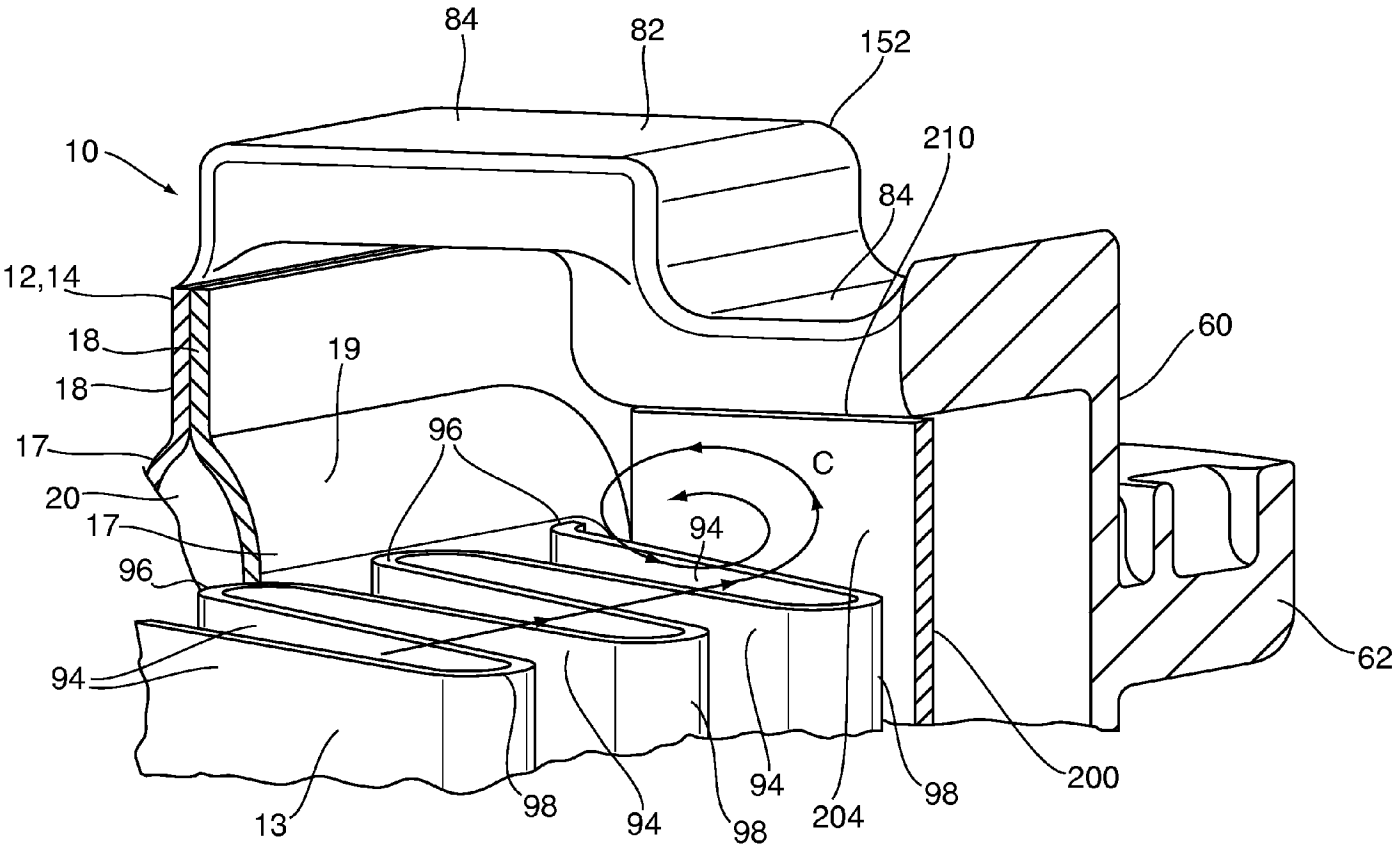
FIG. 8 is an enlarged, rear perspective view of the first end of the heat exchanger of FIG. 3.

Specific reference is now made to FIGS. 6 to 8, to explain the benefits of fin support structure 200 in more detail. As explained above, the width $W_3$ of support structure 200 is greater than the width $W_2$ of the fins 13, and may be substantially the same as the width $W_1$ of the core 12 and of plate pairs 14. For ease of manufacturing, the edge of support structure 200 distal from bracket 152 (i.e. see FIGS. 6 and 7—also referred to herein as the "bottom edge") is substantially flush with the bottom edge of core 12 and plate pair 14. This may help to simplify assembly of heat exchanger 10. The edge of the support structure 200 proximate to bracket 152 (i.e. see FIGS. 6 to 8—also referred to herein as the "top edge") is located close to bracket 152, so as to minimize the size of any gaps through which air can flow around the first end 33 of core 12. In the embodiment illustrated in FIGS. 6 to 8, where the upper edge of the end mounting bracket 152 includes a comb arrangement 82 which includes teeth 84 extending into the spaces 19 between plate pairs 14, such that the width $W_3$ of support structure 200 is less than the width $W_1$ of the core 12, but is nevertheless greater than the width $W_2$ of the fins 13. It will be appreciated that the edge of support structure 200 proximate to bracket 152 may be castellated so as to form a closer fit with the comb arrangement 82 of the bracket, and/or the comb arrangement 82 may be eliminated, in which case the width $W_3$ of support structure 200 will be substantially the same as the width $W_1$ of the core 12.

Regardless of the closeness of the fit between the support structure 200 and the bracket 152, there will inevitably be a gap 210 (FIG. 8) between these two components, through which a portion of the air flowing through heat exchanger 10 can bypass the gas flow passages 19. This is partly due to manufacturing tolerances, and partly due to the fact that the mounting bracket 152 and the heat exchanger core 12 will be made from dissimilar materials, the mounting bracket 152 typically being made from plastic, and core 12 comprising aluminum. Furthermore, it is not sufficient to merely minimize the gap between the support structure 200 and the mounting bracket 152, since the velocity of the air flowing sideways across the top edge of cooling fins 13 (parallel to axis Z) will increase as the gap size is reduced, increasing the potential for shear damage to the fins 13.

Notwithstanding the presence of any gaps, however, the support structure 200 will protect fins 13 from shear damage along the top edge of fin 13 because the width $W_3$ of support structure 200 is greater than the width $W_2$ of the fin 13 in each of the gas flow passages 19. In this regard, FIGS. 6 to 8 show that the top edge of support structure 200 extends above the top edge of the fin 13. Thus, assuming that there is a gap 210 between the top edge of support structure 200 and the bottom surface of bracket 152, air impinging on the fronts of the air flow passages 19 (along axis X), near the rear edge of the comb arrangement 82, will tend to flow sideways along the top edge of fin 13 (parallel to axis Z) toward the gap 210. However, the air will impinge on the upstanding top edge of support structure 200, and will tend to flow upwardly away from the top edge of fin 13 toward the gap. In other words, the presence of the protruding top edge of the support structure causes a re-circulation effect which results in the air flowing up and over the top edge of the cooling fin 13. This is illustrated by arrow C in FIG. 8. The diffusion and re-circulation of the air within this head space prevents the creation of high lateral air velocities over the top edges of the cooling fins 13, parallel to axis Z. Thus, this feature helps to minimize shear damage along the top edge of fin 13. The extent by which the top edge of support structure 200 extends above the top edge of fin 13 is variable, and may be on the order of about 0.5 to about 5 mm.

Also, as can be appreciated from the drawings, any air which succeeds in passing through gap 210 will be in contact with the relatively thick metal of the support structure 200 as it flows parallel to axis X along the first end 33 of core 12, thus preventing damage to the edge of fin 13 which extends parallel to the axis X.

Lastly, once the air flows along axis X and reaches the bottom edge of support structure 200, it will once again flow along axis Z toward the outlet. Any shear damage to the bottom edge of fin 13 is prevented by the bottom edge of support structure 200, which extends below the bottom edge of fin 13.

The corrugated structure of fin support structure 200 permits some amount of flexibility, allowing the support structure 200 to adapt to changes in height of the heat exchanger core 12 pre- and post-brazing, or to adapt to variances in height of the fins 13, while maintaining adequate contact with the fins and with the core plates 18, top plate 42 and/or bottom plate 44.

FIG. 11 illustrates a heat exchanger 10 with an alternate form of fin support structure 300, which shares a number of common features with fin support structure 200 described above. Like elements of fin support structures 200 and 300 are therefore identified by like reference numerals.

The fin support structure 300 is comprised of a number of discrete U-shaped elements 302, each comprising a support wall 202*a* joined at its ends to a pair of axial walls 204. The support walls 202*a* are substantially transverse to a longitudinal axis defined by the long dimensions of the plate pairs 14, while the axial walls 204 are substantially parallel to the axis.

Figure 12:
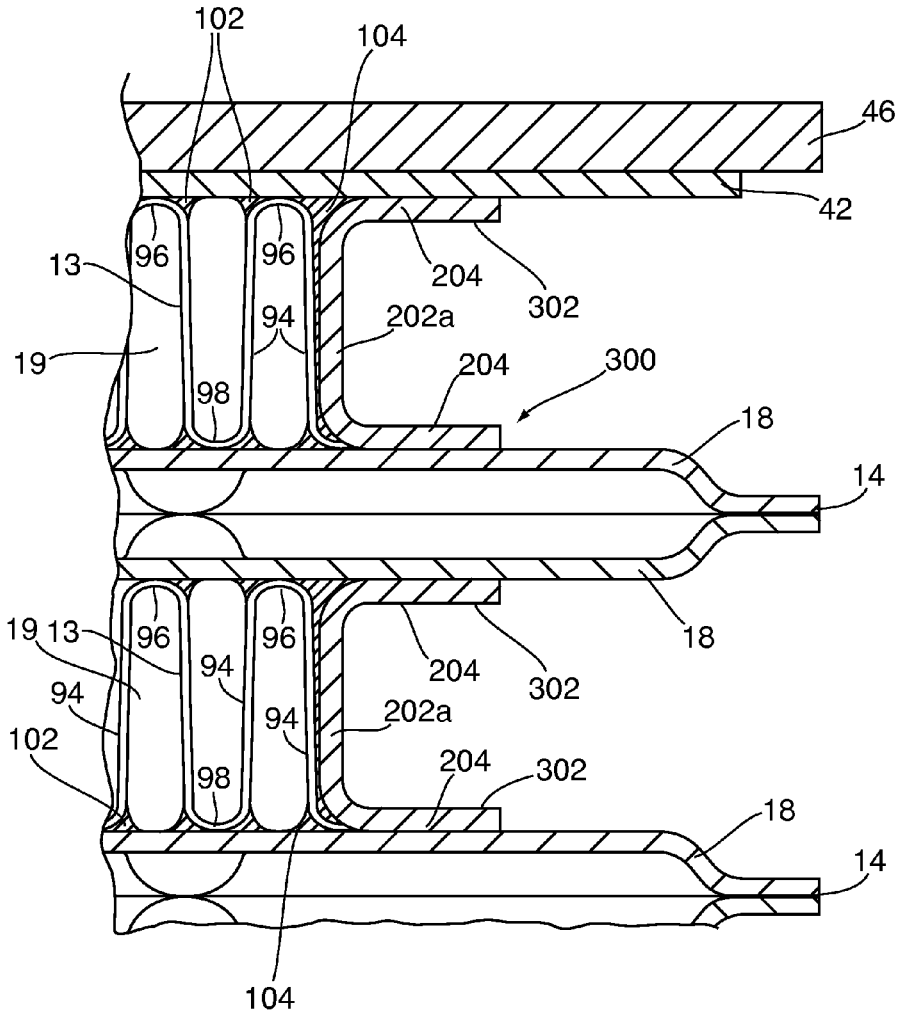
FIG. 12 is a partial, enlarged cross sectional view of the first end of a heat exchanger having a fin support structure according to a second embodiment of the invention.

The support walls 202*a* of fin support structure 300 are located inwardly of the ends of plate pairs 14. Each support wall 202*a* extends between two adjacent plate pairs 14, or between a plate pair 14 and the top or bottom plate 42, 44, and is in contact with the sidewall 94 of the endmost corrugation of one of the fins 13. Support may be enhanced by brazing together the endmost corrugations and the support walls 202*a* which are in contact with one another, and braze fillets 102 are shown in FIG. 12.

Each of the axial walls 204 is in contact with a core plate 18 of a plate pair 14 or with the top plate 42 or bottom plate 44. Braze joints may also be provided between each axially extending wall portion 204 and the core plate 18, top plate 42 or bottom plate 44 which it is in contact with, and braze fillets 104 are shown in FIG. 12.

It will be seen that the fin support structure 300 is substantially the same as fin support structure 200 except for the absence of connecting walls 202*b*. Due to the flexibility between the support walls 202*a* and the axial walls 204, the fin support structure 300 is also adaptable to variations in height of the heat exchanger core 12.

Figure 13:
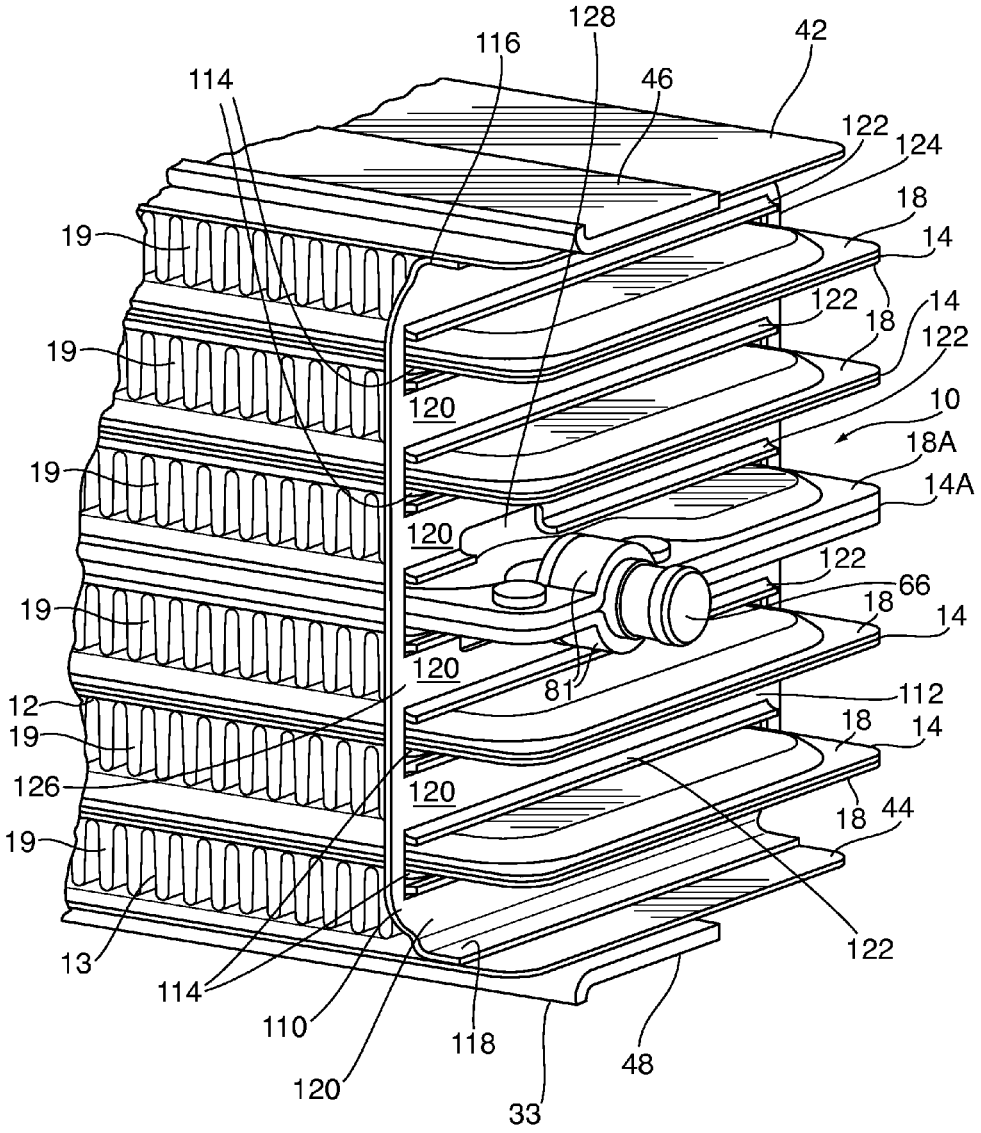
FIG. 13 is a partial perspective view of a heat exchanger having a fin support structure according to a third embodiment of the invention.

An alternate form of fin support structure 110 according to an embodiment of the invention is now described with reference to FIGS. 13-15. For convenience FIG. 13 eliminates the mounting bracket 152. However, it will be appreciated that the mounting bracket of FIG. 13 may be the same as bracket 152 described above.

The fin support structure 110 comprises a rectangular plate 112 having a height H which is substantially the same as the distance between the end plates 42, 44, and a width W which is greater than the width of the heat exchanger core 12. The fin support structure 110 has a plurality of rectangular apertures 114 spaced apart along its height, each of the apertures 114 closely receiving the end of one of the plate pairs 14. The top and bottom edges of plate 112 are bent at an angle of about 90 degrees to form top flange 116 and bottom flange 118, the top flange 116 contacting top plate 42 and the bottom flange contacting the bottom plate 44. The top and bottom flanges 116, 118 are formed so that they extend toward the end of the core 12, away from fins 13, and may be brazed to the respective top and bottom plates 42, 44.

The plate 112 includes support wall portions 120 between adjacent apertures 114 and between flanges 116, 118 and the adjacent apertures 114. These support wall portions 120 correspond in function to support walls 202*a* of fin support structure 200, and are located inwardly of the ends of plate pairs 14. Each of the support wall portions 120 is in contact with, and may be brazed to, the sidewall 94 of the endmost corrugation of one of the fins 13 in the manner described above with reference to support structures 200 and 300.

The apertures 114 may be formed by cutting widthwise slits in the plate 112 and bending the metal adjacent to the slits outwardly to form axial flanges 122. The axial flanges 122 are substantially parallel to the longitudinal axis and are formed so that they extend toward the end of the core 12, away from fins 13. Each of the axial flanges 122 is in contact with a core plate 18 and may be brazed to that core plate 18.

In the illustrated embodiment axial flanges 122 are provided along the top and bottom edges of each aperture 114, and therefore each plate pair 14 has both its upper and lower core plate 18 in contact with one of the axial flanges 122.

As the plate pair 14A carrying mounting pin 66 may be thicker than the other plate pairs, the aperture 114 receiving this plate pair 14A is higher, and therefore the axial flanges 122 adjacent to this aperture 114 may be longer than the axial flanges of the other apertures. In addition, the aperture 114 for plate pair 14A is enlarged by a cutout 128 for the mounting pin 66.

It can be seen that the support wall portions 120 and axial flanges 122 of this embodiment provide additional support along the edges of the fins 13, particularly where the support wall portions 120 and the axial flanges 122 are brazed to the surfaces of the fins 13, core plates 18, top plate 42 and/or bottom plate 44 which they are in contact with.

The edges of apertures 114 are spaced from the edges of plate 112, such that continuous edge pieces 124, 126 extend along the entire height of fin support structure 110.

Figure 15:
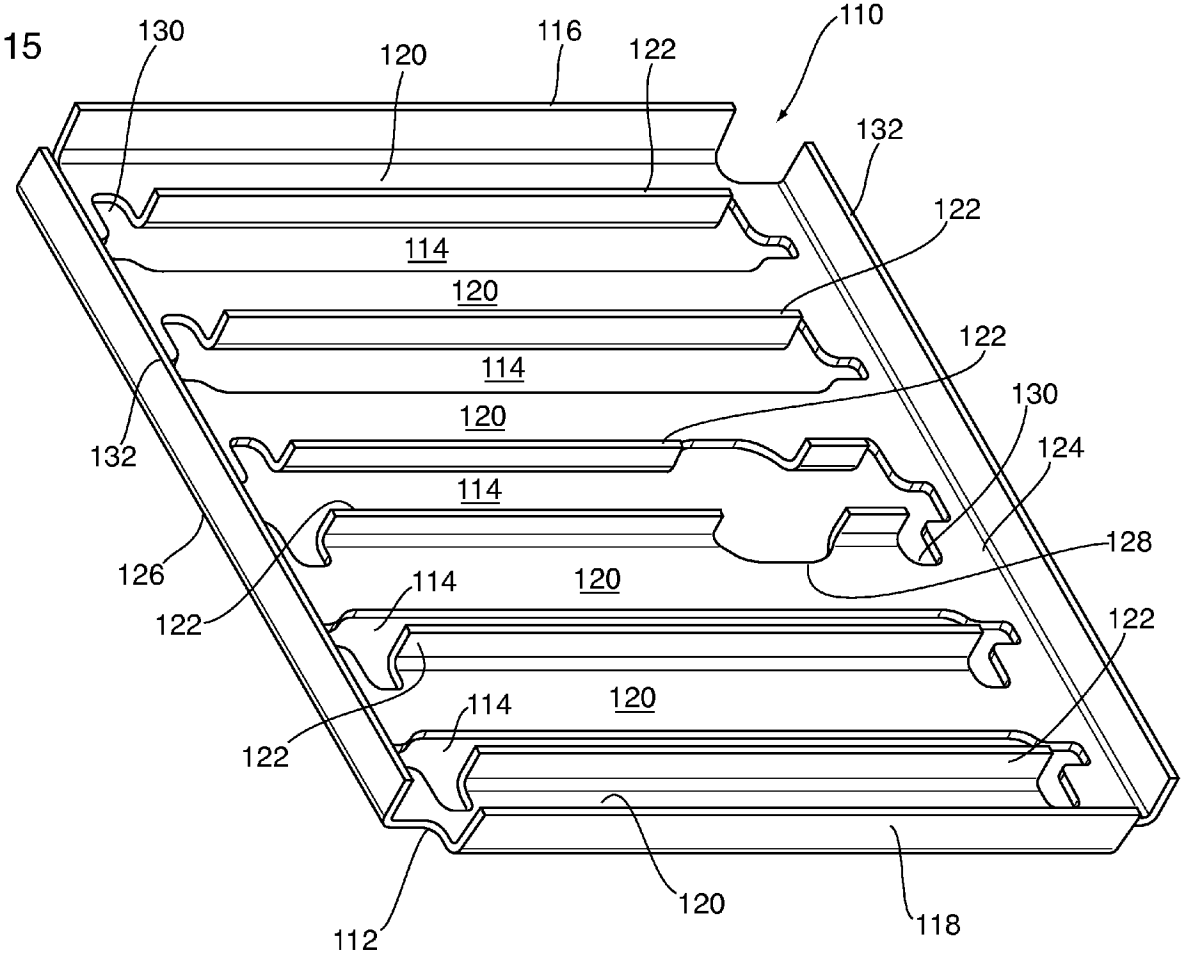
FIG. 15 is an isolated view of a second variant of the fin support structure in the heat exchanger of FIG. 13.

FIG. 15 shows a variant of the fin support structure 110 in which all the apertures 114, except the larger aperture 114 which receives the plate pair 14A, are provided with an axial flange 122 along only one of the edges of the apertures 114. The single axial flanges 122 and associated apertures 114 are formed by bending the metal adjacent to one side of each slit outwardly to form an axial flange 122. The single flanges 122 according to this embodiment are about twice as high as the flanges 122 in the variant of FIG. 13.

Figure 14:
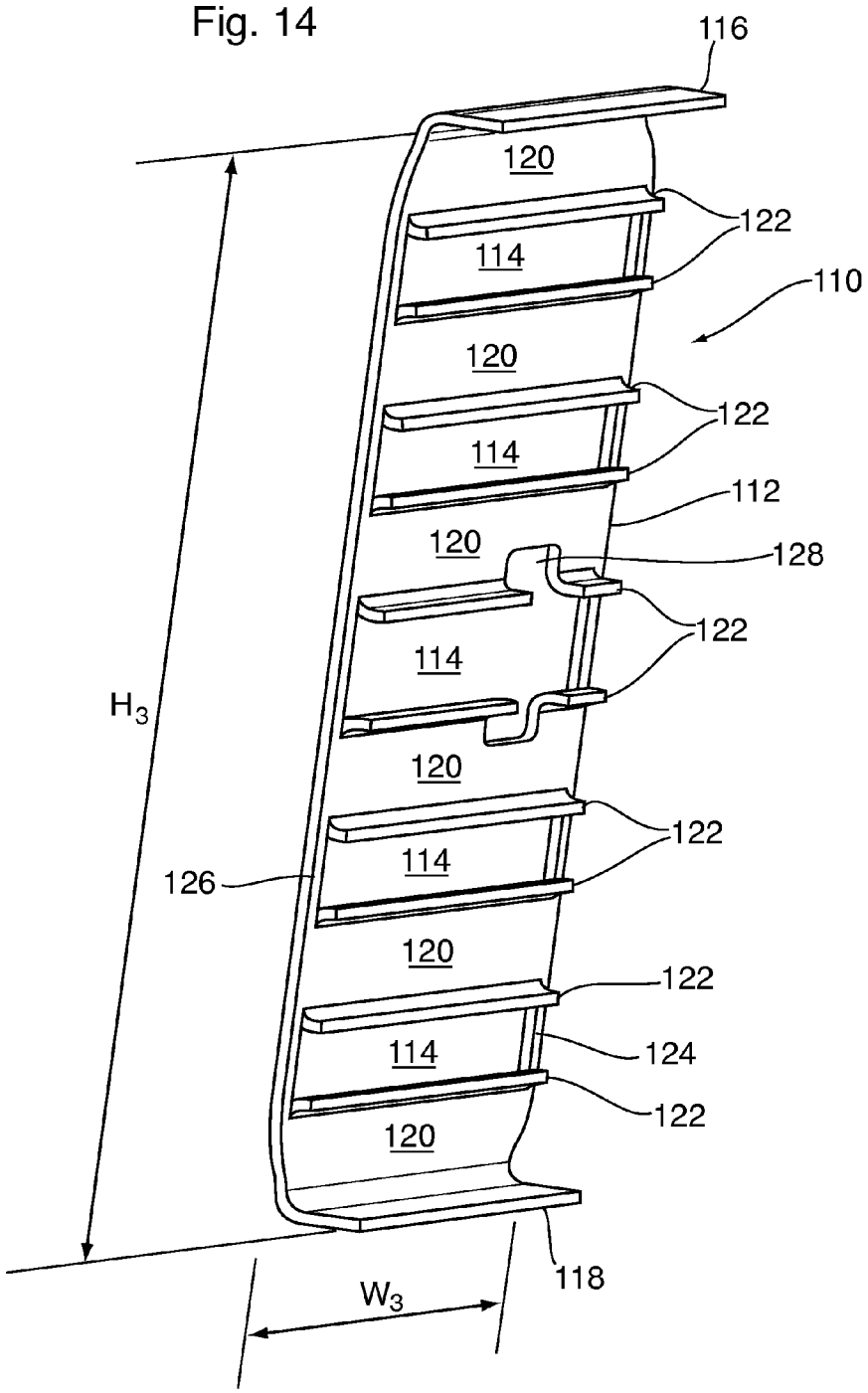
FIG. 14 is an isolated view of a first variant of the fin support structure in the heat exchanger of FIG. 13.

To enhance the flexibility of flanges 122 in the variant of FIG. 14, cutouts are provided along the sides of the axial flanges 122. The enhanced flexibility of the axial flanges 122 improves the fin support structure's ability to adapt to changes in core height described above.

To enhance rigidity of the plate along its height, the edge pieces 124, 126 may be bent to form axial stiffening flanges 132.

Although the invention has been described in connection with certain embodiments, it is not limited thereto. Rather, the invention includes all embodiments which may fall within the scope of the following claims.

What is claimed is:

1. A heat exchanger having a core comprising:

(a) a plurality of flat tubes arranged in parallel relation to one another in a stack, wherein spaces are defined between adjacent pairs of said tubes, wherein the tubes have a length which is defined in a direction parallel to a longitudinal axis and a width transverse to the longitudinal axis, wherein the core has a first end and a second end spaced apart along the longitudinal axis, and wherein each of the tubes has a hollow interior defining a first fluid flow passage;

(b) a plurality of corrugated cooling fins, wherein each of the fins is provided in a space between an adjacent pair of said tubes, wherein each of the spaces defines a second fluid flow passage, wherein each of the fins comprises a metal sheet in which a plurality of parallel bends define a series of corrugations, the corrugations comprising a plurality of side walls, top walls and bottom walls, wherein the side walls are arranged in spaced, side-by-side relation to one another, with adjacent side walls being joined together by one of said top walls or one of said bottom walls;

wherein the top walls and bottom walls are each in contact with one tube of the adjacent pair of tubes, and wherein the side walls extend transversely along the width of the tubes;

wherein an edge of the fin extends along the first end of the core, and is spaced inwardly from the first end, the edge of the fin being defined by an endmost one of said corrugations; and (c) a fin support structure comprising a plurality of support walls and a plurality of axial walls, wherein each of the support walls is integrally joined to at least one of the axial walls, wherein each of the support walls is in contact with the endmost corrugation of one of the fins, and wherein each of the axial walls is in contact with one of the tubes;

wherein the fin support structure has a corrugated structure wherein each of the support walls of the fin support structure is integrally joined at its top edge to a first one of said axial walls, and is integrally joined at its bottom edge to a second one of said axial walls;

wherein the fin support structure further comprises a plurality of connecting walls, each of which is integrally joined at its top edge to a first one of said axial walls, and is integrally joined at its bottom edge to a second one of said axial walls, wherein the connecting walls are located beyond the first end of the core and are spaced longitudinally from the support walls; and wherein the heat exchanger further comprises a bracket mounting pin extending from the first end of the core, and wherein the fin support structure has a cutout in one of its connecting walls to receive the bracket mounting pin.

2. The heat exchanger of claim 1, wherein each of the support walls is brazed to the endmost corrugation of one of the fins, and wherein each of the axial walls is brazed to one of the tubes.

3. The heat exchanger of claim 1, wherein each of the support walls of the fin support structure is integrally joined at its top edge to a first one of said axial walls, and is integrally joined at its bottom edge to a second one of said axial walls, such that each of the support walls and the axial walls to which it is joined to form a U-shaped channel; and wherein the fin support structure comprises a plurality of said U-shaped channels.

4. The heat exchanger of claim 1, further comprising a mounting bracket mounted on said mounting pin, the mounting bracket having a vertical plate portion in close proximity to the fin support structure, wherein a plurality of the connecting walls of the fin support structure have cutouts which together correspond to the shape and size of the vertical plate portion.

5. The heat exchanger of claim 1, wherein the fin support structure comprises a plate having a plurality of apertures spaced apart along its height, each of the apertures being sized and shaped to closely receive a closed end of one of the tubes;

wherein the support walls of the fin support structure comprise portions of said plate extending between adjacent pairs of said apertures; and wherein the axial walls of the fin support structure comprise axial flanges extending from edges of the apertures.

6. The heat exchanger of claim 5, wherein the apertures are formed by cutting widthwise slits in the plate and wherein the axial flanges are formed by outwardly bending portions of the plate adjacent to the slits.

7. The heat exchanger of claim 6, wherein the axial flanges are provided along top and bottom edges of each of the apertures.

8. The heat exchanger of claim 6, wherein each of said axial flanges is formed along either a top edge or a bottom edge of one of said apertures.

9. The heat exchanger of claim 8, wherein at least some of said apertures are each provided with a first one of said axial flanges along its top edge and a second one of said axial flanges along its bottom edge, and/or wherein at least some of said apertures are each provided with a single one of said axial flanges, which is provided along its top or bottom edge.

10. The heat exchanger of claim 6, wherein the apertures have edges which are spaced from edges of the plate, such that continuous edge pieces extend along substantially the entire height of the fin support structure; and wherein the continuous edge pieces are bent along their length to form axial stiffening flanges.

11. The heat exchanger of claim 1, wherein each of the flat tubes comprises a pair of core plates, each of which has a planar peripheral flange surrounding a raised central portion, and wherein the core plates of each said pair are arranged in face-to-face relation with one another, with the peripheral flanges of the plates joined together and with the raised central portions spaced apart to define said hollow interior of the flat tube.

12. The heat exchanger of claim 1, further comprising a top plate and a bottom plate, wherein a first space is defined between the top plate and a first one of said flat tubes which is adjacent to the top plate, and a second space is defined between the bottom plate and a second one of said flat tubes which is adjacent to the bottom plate, and wherein the core comprises a first additional corrugated cooling, fin which is provided in the first space and a second additional corrugated cooling fin which is provided in the second space.

13. The heat exchanger of claim 1, wherein the flat tubes are closed at the first end of the core.

14. The heat exchanger of claim 1, wherein a width of each said corrugated cooling fin is less than the width of each said flat tube with which it is in contact, and wherein the width of each said corrugated cooling fin is less than a width of the fin support structure.

15. The heat exchanger of claim 14, wherein the fin support structure has a pair of edges separated by the width of the fin support structure, and wherein at least one edge of the edges of the fin support structure extends beyond an edge of the corrugated cooling fin.

16. The heat exchanger of claim 4, wherein a width of each said corrugated cooling fin is less than the width of each said flat tube with which it is in contact, and wherein the width of each said corrugated cooling fin is less than a width of the fin support structure;

wherein the fin support structure has a pair of edges separated by the width of the fin support structure, and one of said edges is in close proximity to said mounting bracket;

wherein said one edge of the fin support structure extends beyond an edge of the corrugated cooling fin; and wherein said one edge of the fin support structure is separated from the mounting bracket by a gap.

17. A heat exchanger having a core comprising:

(a) a plurality of flat tubes arranged in parallel relation to one another in a stack, wherein spaces are defined between adjacent pairs of said tubes, wherein the tubes have a length which is defined in a direction parallel to a longitudinal axis and a width transverse to the longitudinal axis, wherein the core has a first end and a second end spaced apart along the longitudinal axis, and wherein each of the tubes has a hollow interior defining a first fluid flow passage;

(b) a plurality of corrugated cooling fins, wherein each of the fins is provided in a space between an adjacent pair of said tubes, wherein each of the spaces defines a second fluid flow passage, wherein each of the fins comprises a metal sheet in which a plurality of parallel bends define a series of corrugations, the corrugations comprising a plurality of side walls, top walls and bottom walls, wherein the side walls are arranged in spaced, side-by-side relation to one another, with adjacent side walls being joined together by one of said top walls or one of said bottom walls;

wherein the top walls and bottom walls are each in contact with one tube of the adjacent pair of tubes, and wherein the side walls extend transversely along the width of the tubes;

wherein an edge of the fin extends along the first end of the core, and is spaced inwardly from the first end, the edge of the fin being defined by an endmost one of said corrugations;

(c) a fin support structure comprising a plurality of support walls and a plurality of axial walls, wherein each of the support walls is integrally joined to at least one of the axial walls, wherein each of the support walls is in contact with the endmost corrugation of one of the fins, and wherein each of the axial walls is in contact with one of the tubes;

(d) a bracket mounting pin extending from the first end of the core; and (e) a mounting bracket mounted on said mounting pin, the mounting bracket comprising:

a first wall portion in close proximity to the fin support structure and extending widthwise along the first end of the core, and through which the bracket is mounted on said mounting pin;

a second wall portion projecting from the first wall portion at an angle of about 90 degrees and extending over a portion of the heat exchanger core;

wherein the second wall portion covers a portion of each of the spaces between adjacent pairs of said flat tubes, and longitudinally overlaps the edge of each said corrugated cooling fin which extends along the first end of the core.

18. The heat exchanger of claim 17, wherein the second wall comprises a comb arrangement having a plurality of spaced-apart teeth, wherein each of the teeth extends into one of said spaces between an adjacent pair of said flat tubes.

19. The heat exchanger of claim 18, wherein said bracket mounting pin is mounted on an end of a first one of said flat tubes, wherein the first fluid flow passage of said first flat tube is spaced from the first end of the core by a distance which is greater than a distance between the first fluid flow passage and the first end of the core in the other flat tubes, wherein the corrugated cooling fins in the spaces adjacent to said first flat tube are spaced away from the first end of the core by a distance which is at least as great as the distance between the first fluid flow passage of the first flat tube and the first end of the core; and wherein the teeth of the comb arrangement extending into the spaces between the first flat tube and adjacent tubes of the core are elongated along the longitudinal axis, relative to the other teeth, so as to overlap the edges of the corrugated cooling fins in said spaces.

20. The heat exchanger of claim 17, wherein each of the support walls of the fin support structure is integrally joined at its top edge to a first one of said axial walls, and is integrally joined at its bottom edge to a second one of said axial walls, such that each of the support walls and the axial walls to which it is joined to form a U-shaped channel;

wherein the fin support structure comprises a plurality of said U-shaped channels; and wherein each of said U-shaped channels is individually formed.

* * * * *